US012025130B2

(12) United States Patent
Hirayama et al.

(10) Patent No.: US 12,025,130 B2
(45) Date of Patent: Jul. 2, 2024

(54) ROTARY COMPRESSOR AND REFRIGERATION CYCLE APPARATUS

(71) Applicant: Toshiba Carrier Corporation, Kawasaki (JP)

(72) Inventors: Takuya Hirayama, Fuji (JP); Shigeki Kimura, Fuji (JP)

(73) Assignee: TOSHIBA CARRIER CORPORATION, Kawasaki (JP)

( * ) Notice: Subject to any disclaimer, the term of this patent is extended or adjusted under 35 U.S.C. 154(b) by 661 days.

(21) Appl. No.: 17/205,243

(22) Filed: Mar. 18, 2021

(65) Prior Publication Data

US 2021/0207601 A1 Jul. 8, 2021

Related U.S. Application Data

(63) Continuation of application No. PCT/JP2018/034903, filed on Sep. 20, 2018.

(51) Int. Cl.
*F04C 18/356* (2006.01)
*F04C 23/00* (2006.01)

(52) U.S. Cl.
CPC ..... *F04C 18/3564* (2013.01); *F04C 23/001* (2013.01); *F04C 2240/40* (2013.01); *F04C 2240/50* (2013.01); *F04C 2240/60* (2013.01)

(58) Field of Classification Search
CPC ..... F04C 18/356; F04C 18/3562; F04C 18/3564; F04C 18/3566; F04C 18/3568;
(Continued)

(56) References Cited

U.S. PATENT DOCUMENTS

2010/0147013 A1* 6/2010 Hirayama ..... F04C 23/008 62/401
2012/0014816 A1* 1/2012 Choi ..... F04C 29/12 417/244

(Continued)

FOREIGN PATENT DOCUMENTS

CN 1482364 A 3/2004
CN 102644594 A 8/2012

(Continued)

OTHER PUBLICATIONS

Chinese official action dated Apr. 2, 2022, and English translation, in connection with Chinese Patent Application No. 201880097262.0.

(Continued)

*Primary Examiner* — Mark A Laurenzi
*Assistant Examiner* — Xiaoting Hu
(74) *Attorney, Agent, or Firm* — John P. White

(57) ABSTRACT

According to one embodiment, a rotary compressor includes a compression mechanism unit. When H is the length of a middle shaft part, Hp is the length of a bearing hole, Dp is the inner diameter of the bearing hole, Dc is the outer diameter of a crank part, Dm is the outer diameter of the middle journal part, C1 is the axial length of a first chamfered part provided to a middle shaft part-side end edge of the crank part, C2 is the axial length of a second chamfered part, C3 is the axial length of a third chamfered part, and C4 is the axial length of a fourth chamfered part, Dp is larger than Dc and Dm, and the relationships of [Equation 1] $H \leq Hp$, [Equation 2] $H > Hp - C1 - C2 - \sqrt{(Dp^2 - Dc^2)}$, and [Equation 3] $H > Hp - C3 - C4 - \sqrt{(Dp^2 - Dm^2)}$ are all satisfied.

6 Claims, 11 Drawing Sheets

(58) Field of Classification Search
CPC .. F04C 23/001; F04C 23/003; F04C 2240/40; F04C 2240/50; F04C 2240/60; F04C 29/005; F04C 29/0057; F04C 2230/60; F04C 2230/601; F04C 2230/602; F04C 2230/603
See application file for complete search history.

(56) References Cited

U.S. PATENT DOCUMENTS

| | | | | |
|---|---|---|---|---|
| 2014/0250937 | A1* | 9/2014 | Hirayama | F04C 29/065 418/60 |
| 2017/0167487 | A1* | 6/2017 | Nakai | F04C 29/0057 |

FOREIGN PATENT DOCUMENTS

| | | | | |
|---|---|---|---|---|
| CN | 103032328 | A | 4/2013 | |
| CN | 106030113 | A | 10/2016 | |
| EP | 2770212 | A1 * | 8/2014 | F04C 18/356 |
| EP | 3163084 | A1 | 5/2017 | |
| JP | H5-312172 | A | 11/1993 | |
| JP | H10-213087 | A | 8/1998 | |
| JP | 2004-100608 | A | 4/2004 | |
| JP | 2004100608 | A * | 4/2004 | |
| JP | 2010-101169 | A | 5/2010 | |
| WO | WO 2015/198539 | A1 | 12/2015 | |

OTHER PUBLICATIONS

International Search Report dated Nov. 27, 2018 in connection with PCT International Application No. PCT/JP2018/034903.
European search report dated Mar. 29, 2022 in connection with European Patent Application No. 18 93 4328.

* cited by examiner

ROTARY COMPRESSOR AND REFRIGERATION CYCLE APPARATUS

CROSS-REFERENCE TO RELATED APPLICATIONS

This application is a Continuation Application of PCT Application No. PCT/JP2018/034903, filed Sep. 20, 2013, the entire contents of which are incorporated herein by reference.

FIELD

Embodiments described herein relate generally to a multi-cylinder rotary compressor and a refrigeration cycle apparatus comprising the rotary compressor.

BACKGROUND

For example, a multi-cylinder rotary compressor used in an air conditioner comprises a compression mechanism unit that compresses a refrigerant inside a sealed container.

The compression mechanism unit comprises a plurality of cylinder chambers separated by a partition plate, and a rotating shaft including a plurality of crank portions accommodated in the cylinder chambers. A roller fitted in an outer peripheral surface of each crank portion eccentrically rotates in the cylinder chamber. The volumes of a suction region and a compression region of the cylinder chamber change and the refrigerant sucked into the suction region is compressed.

Incidentally, the rotating shaft of the compression mechanism unit is rotatably supported by bearings at two places with a plurality of crank portions interposed therebetween. According to this configuration, as the number of crank portions increases, the span between the bearings becomes longer, and the rotating shaft is easily bent between the bearings, particularly during a high-speed operation in which the rotating shaft rotates at a high speed.

As a measure, a rotary compressor in which an intermediate journal portion is provided between two adjacent crank portions of the rotating shaft and the intermediate journal portion is rotatably supported by the partition plate has been developed. According to this type of rotary compressor, the span between the bearings supporting the rotating shaft is shortened and the bending and axial deflection of the rotating shaft can be suppressed since the partition plate also functions as a bearing.

In a rotary compressor in which a partition plate also serves as a bearing, lubricating oil is supplied to a sliding portion between the intermediate journal portion of the rotating shaft and the partition plate. Furthermore, in order to secure a space for temporarily storing the lubricating oil between the intermediate journal portion and the crank portion located on an upper side, the intermediate journal portion is located exactly at a middle part between two adjacent crank portions.

In order to desirably maintain the lubrication of the intermediate journal portion, it is desirable to sufficiently secure a length of the sliding portion between the intermediate journal portion and the partition plate, in the axial direction of the rotating shaft. However, when the sliding portion is made longer, the full length of the rotating shaft inevitably increases, which is one of factors hindering the compactness of the rotary compressor.

Furthermore, a gap is required between the intermediate journal portion and one of the crank portions adjacent to the intermediate journal portion to incorporate the partition plate on the rotating shaft. Increase of the span between the intermediate journal portion and the bearing by this gap cannot be avoided.

As a result, the rotating shaft may be bent between the intermediate journal portion and the bearing during the operation of the rotary compressor, and there is room for improvement in improving the performance and reliability of the rotary compressor.

Embodiments described herein aim to obtain a compact rotary compressor capable of keeping the full length of a rotating shaft short while ensuring lubrication of an intermediate journal portion of the rotating shaft.

DETAILED DESCRIPTION

Figure 1:
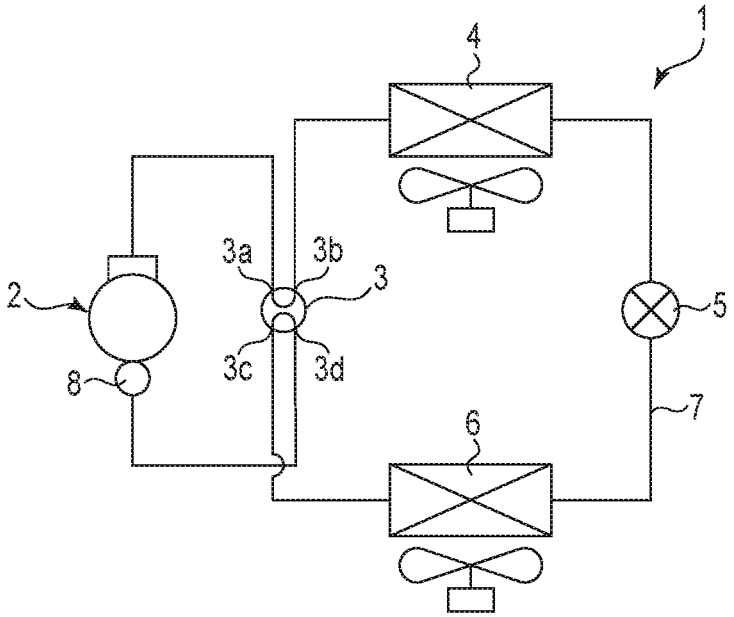
FIG. 1 is a circuit diagram schematically showing a configuration of a refrigeration cycle apparatus according to a first embodiment.

In general, according to one embodiment, the rotary compressor comprises a sealed container, a compression mechanism unit accommodated in the sealed container to compress a working fluid, and a drive source that drives the compression mechanism unit.

The compression mechanism unit includes a rotating shaft connected to the drive source, a first bearing and a second bearing rotatably supporting the rotating shaft, a plurality of cylinder bodies interposed between the first bearing and the second bearing and spaced apart and arranged in an axial direction of the rotating shaft, and defining cylinder chambers, respectively, and a partition plate provided between the adjacent cylinder bodies and including bearing holes.

The rotating shaft includes a first journal portion supported by the first bearing, a second journal portion supported by the second bearing, a plurality of disk-shaped crank portions located between the first journal portion and the second journal portion and accommodated in the cylinder chambers, an intermediate journal portion provided at a position closer to a side of one of the crank portions, between the crank portions adjacent in the axial direction of the rotating shaft, and slidably supported by the bearing hole of the partition plate, and an intermediate shaft portion straddling between the other crank portion adjacent to the second bearing and the intermediate journal, and having a diameter smaller than the intermediate journal portion.

When a length in the axial direction of the intermediate shaft portion of the rotating shaft is referred to as H, a length in the axial direction of the bearing hole of the partition plate is referred to as Hp, an inner diameter of the bearing hole of the partition plate is referred to as Dp, an outer diameter of the other crank portion adjacent to the second bearing is referred to as Dc, an outer diameter of the intermediate journal portion of the rotating shaft is referred to as Dm, an axial length of a first chamfered portion provided at an edge located on a side of the intermediate shaft portion, of the other crank portion, is referred to as C1, an axial length of a second chamfered portion provided at an opening edge located on the side of the other crank portion, of the bearing hole, is referred to as C2, an axial length of a third chamfered portion provided at an edge on the side of the intermediate shaft portion, of the intermediate journal portion, is referred to as C3, and an axial length of a fourth chamfered portion provided at an opening edge located on the side opposite to the second chamfered portion, of the bearing hole, is referred to as C4, Dp is larger than Dc and Dm, and all relationships of $$H \leq Hp \quad \text{[Equation 1]}$$

$$H > Hp - C1 - C2 - \sqrt{(Dp^2 - Dc^2)} \quad \text{[Equation 2]}$$

$$H > Hp - C3 - C4 - \sqrt{(Dp^2 - Dm^2)} \quad \text{[Equation 3]}$$

are satisfied.

First Embodiment

A first embodiment will be described hereinafter with reference to FIG. 1 to FIG. 10.

FIG. 1 is a refrigeration cycle circuit diagram of an air conditioner 1, which is, for example, an example of a refrigeration cycle apparatus. The air conditioner 1 comprises a rotary compressor 2, a four-way valve 3, an outdoor heat exchanger 4, an expansion device 5, and an indoor heat exchanger 6 as main elements. The plurality of elements constituting the air conditioner 1 are connected via a circulation circuit 7 in which a refrigerant serving as a working fluid circulates.

More specifically, as shown in FIG. 1, the discharge side of the rotary compressor 2 is connected to a first port 3*a* of the four-way valve 3. A second port 3*b* of the four-way valve 3 is connected to the outdoor heat exchanger 4. The outdoor heat exchanger 4 is connected to the indoor heat exchanger 6 via the expansion device 5. The indoor heat exchanger 6 is connected to a third port 3*c* of the four-way valve 3. A fourth port 3*d* of the four-way valve 3 is connected to an accumulator 3 which is the suction side of the accumulator 8 rotary compressor 2.

When the air conditioner 1 operates in the cooling mode, the four-way valve 3 is switched such that the first, port 3*a* communicates with the second port 3*b* and the third port 3*c* communicates with the fourth port 3*d*. When the operation of the air conditioner 1 is started in the cooling mode, a high-temperature and high-pressure vapor-phase refrigerant compressed by the compression mechanism unit of the rotary compressor 2 is guided to the outdoor heat exchanger 4 that functions as a radiator (condenser) through the four-way valve 3.

The vapor-phase refrigerant guided to the outdoor heat exchanger 4 is condensed by heat exchange with the air and changed into a high-pressure liquid-phase refrigerant. The high-pressure liquid-phase refrigerant is reduced in pressure in the process of passing through the expansion device 5 and is changed to a low-pressure gas-liquid two-phase refrigerant. The gas-liquid two-phase refrigerant is guided to the indoor heat exchanger 6 that functions as a heat absorber (evaporator) and exchanges heat with air in the process of passing through the indoor heat exchanger 6.

As a result, the gas-liquid two-phase refrigerant takes heat from, the air, evaporates, and changes to a low-temperature/low-pressure vapor-phase refrigerant. The air passing through the indoor heat exchanger 6 is cooled by the latent heat of vaporization of the liquid phase refrigerant, and is sent to a place to be air-conditioned (cooled) as cold air.

The low-temperature and low-pressure vapor-phase refrigerant that has passed through the indoor heat exchanger 6 is guided to the accumulator 3 of the rotary compressor 2 and separated into a liquid-phase refrigerant and a vapor-phase refrigerant. The low-temperature and low-pressure vapor-phase refrigerant is sucked into the compression mechanism unit of the rotary compressor 2, and is compressed again into the high-temperature and high-pressure vapor-phase refrigerant and discharged to the circulation circuit 7.

On the other hand, when the air conditioner 1 operates in the heating mode, the four-way valve 3 switches so that the first port 3*a* communicates with the third port 3*c* and the second port 3*b* communicates with the fourth port 3*d*. For this reason, the indoor heat exchanger 6 functions as a condenser, and the air passing through the indoor heat exchanger 6 is heated by heat exchange with the vapor-phase refrigerant, and is sent to a place to be air-conditioned (heated) as warm air.

The high-temperature liquid-phase refrigerant that has passed through the indoor heat exchanger 6 is reduced in pressure in the process of passing through the expansion device 5 and is changed into a low-pressure gas-liquid two-phase refrigerant. The gas-liquid two-phase refrigerant is guided to the outdoor heat exchanger 4 that functions as an evaporator, and then evaporates.

Figure 2:
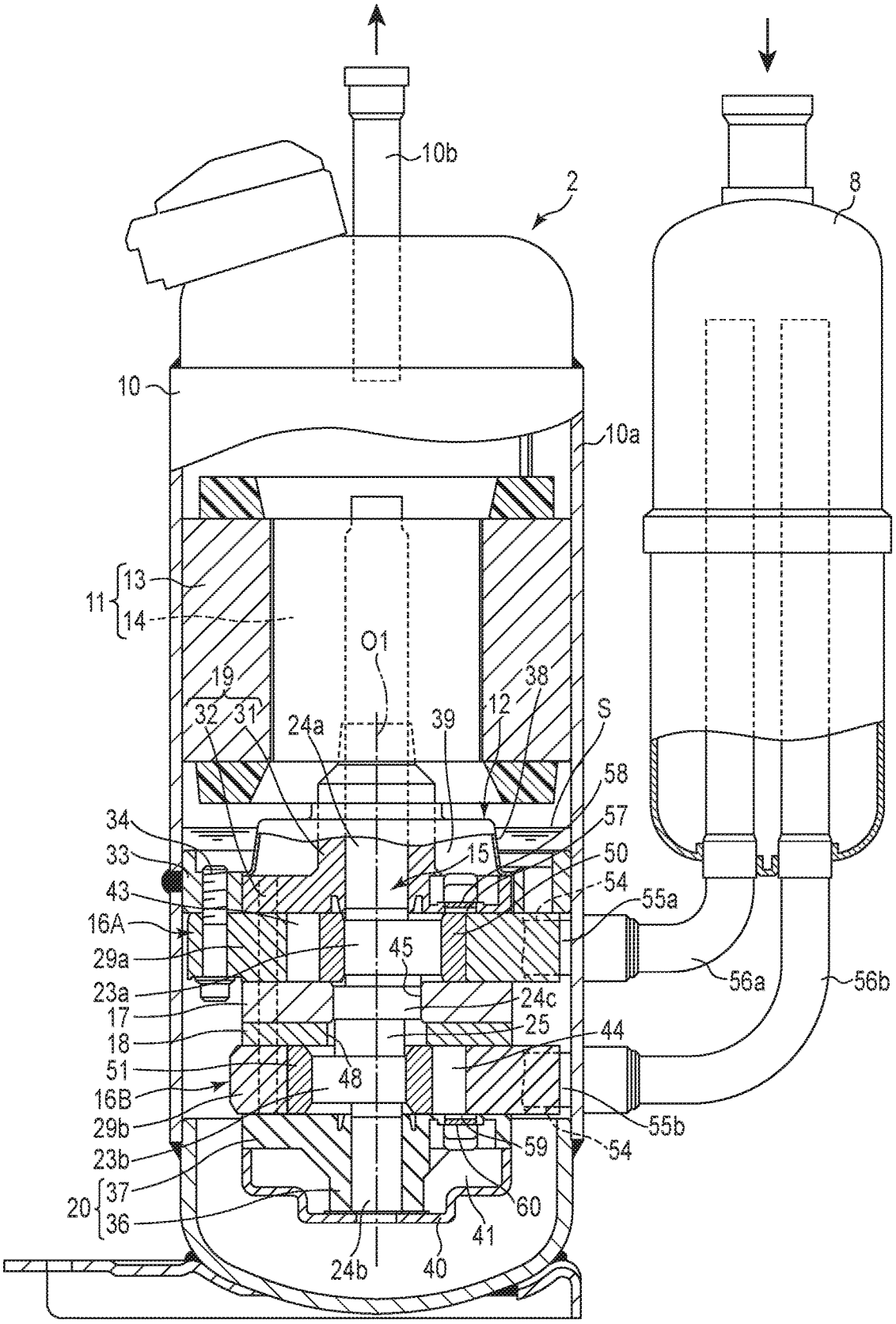
FIG. 2 is a cross-sectional view of a two-cylinder rotary compressor according to the first embodiment.

Next, a specific configuration of the rotary compressor 2 will be described with reference to FIG. 2 to FIG. 10. FIG. 2 is a cross-sectional view showing a vertical two-cylinder rotary compressor 2. As shown in FIG. 2, the two-cylinder rotary compressor 2 includes a sealed container 10, an electric motor 11, and a compression mechanism unit 12 as main elements.

The sealed container 10 includes a cylindrical peripheral wall 10*a* and is erected along the vertical direction. Lubricating oil is stored inside the sealed container 10. Furthermore, a discharge pipe 10*b* is provided at an upper end of the sealed container 10. The discharge pipe 10*b* is connected to the first pert 3*a* of the four-way valve 3 via the circulation circuit 7.

The electric motor 11 is an example of a drive source, and is accommodated in an intermediate part of the sealed container 10 along the axial direction so as to be located above a liquid level S of the lubricating oil. The electric motor 11 is a so-called inner rotor type motor, and includes a stator 13 and a rotor 14. The stator 13 is fixed to an inner surface of the peripheral wall 10*a* of the sealed container 10. The rotor 14 is surrounded by the stator 13.

The compression mechanism part 12 is accommodated in the lower part of the airtight container 10 so that it may be immersed in lubricating oil. As shown in FIG. 2, the compression mechanism unit 12 comprises as main elements a rotating shaft 15, a first refrigerant compression unit 16A, a second refrigerant compression unit 16B, a partition plate 17, a spacer 13, a first bearing 19, and a second bearing 20.

The rotating shaft 15 is located coaxially relative to the sealed container 10, and has a straight central axis O1 that is erected along the axial direction of the sealed container 10. The rotating shaft 15 includes a first journal portion 24*a* located at the upper part, a second journal portion 24*b* located at the lower end part, an intermediate journal portion 24*c* located between the first journal portion 24*a* and the second journal portion 24*b*, an intermediate shaft portion 25 located between the intermediate journal portion 24*c* and the second journal portion 24*b*, a first crank portion 23*a*, and a second crank portion 23*b*. The rotating shaft 15 of the present embodiment is an integrated structure in which the plurality of elements are formed integrally, and upper end part of the first journal portion 24*a* is connected to the rotor 14 of the electric motor 11.

The first journal portion 24*a* and the second journal portion 24*b* are separated in the axial direction of the rotating shaft 15. The intermediate journal portion 24*c* is a disk-shaped element having a circular cross-section and has an outer diameter larger than the first journal portion 24*a* and the second journal portion 24*b*. The first journal portion 24*a*, the second journal portion 24*b*, and the intermediate journal portion 24*c* are coaxially located on the central axis O1 of the rotating shaft 15.

Furthermore, the intermediate shaft portion 25 is continuous with the intermediate journal portion 24*c* on the central axis O1 of the rotating shaft 15 and has an outer diameter smaller than the intermediate journal portion 24*c*.

The first crank portion 23*a* and the second crank portion 23*b* are disk-shaped elements each having a circular cross-section, and are arranged at intervals in the axial direction of the rotating shaft 15.

Furthermore, the first crank portion 23*a* and the second crank portion 23*b* are eccentric with respect to the central axis O1 of the rotating shaft 15. The eccentric directions of the first crank portion 23*a* and the second crank portion 23*b* with respect to the central axis O1 are deviated by, for example, 180 degrees in the circumferential direction of the rotating shaft 15.

The first crank portion 23*a* is interposed between the first journal portion 24*a* and the intermediate journal portion 24*c*. The outer diameter of the first crank portion 23*a* is equal to, for example, the outer diameter of the intermediate journal portion 24*c*.

The second crank portion 23*b* is interposed between the intermediate shaft portion 25 and the second journal portion 24*b*. The outer diameter of the second crank portion 23*b* is smaller than or equal to the outer diameter of the intermediate journal portion 24*c* and is larger than the outer diameter of the intermediate shaft portion 25.

According to the present embodiment, the intermediate journal portion 24*c* is provided at a position between the first crank portion 23*a* and the second crank portion 23*b*, which is closer to the first crank portion 23*a* side than the second crank portion 23*b*. For this reason, the intermediate journal portion 24*c* is separated from the second crank portion 23*b* by the distance corresponding to the axial length of the intermediate shaft portion 25.

In other words, the intermediate shaft portion 25 is located across the intermediate journal portion 24*c* and the second crank portion 23*b* to define a gap corresponding to the axial length of the intermediate shaft portion 25 between the intermediate journal portion 24*c* and the second crank portion 23*b*.

As shown in FIG. 2, the first refrigerant compression unit 16A and the second refrigerant compression unit 16B are spaced apart and arranged in the axial direction of the rotating shaft 15, inside the sealed container 10. The first refrigerant compression unit 16A includes a first cylinder body 29*a*. The second refrigerant compression unit 16B includes a second cylinder body 29*b*. The first and second cylinder bodies 29*a* and 29*b* are set to have, for example, the same thickness along the axial direction of the rotating shaft 15.

Furthermore, the first cylinder body 29*a* of the first refrigerant compression unit 16A is located on the side closer to the electric motor 11 than the second cylinder body 29*b* of the second refrigerant compression unit 16B.

The first partition plate 17 is interposed between the first cylinder body 29*a* and the second cylinder body 29*b*. An upper end surface of the first partition plate 17 is brought into contact with a lower surface of the first cylinder body 29*a* so as to cover the inner diameter part of the first cylinder body 29*a* from below.

The spacer 18 is, for example, an element shaped in a disk thinner than the partition plate 17 and is interposed between the partition plate 17 and the second cylinder body 29*b*. An upper end surface of the spacer 18 is brought into contact with a lower end surface of the partition plate 17. A lower end surface of the spacer 18 is brought into contact with an upper surface of the second cylinder body 29*b* so as to cover the inner diameter part of the second cylinder body 29*b* from above.

As shown in FIG. 2, the first bearing 19 is arranged on the first cylinder body 29*a*. The first bearing 19 includes a tubular bearing body 31 that rotatably supports the first journal portion 24*a* of the rotating shaft 15, and a flange-shaped end plate 32 extending from one end of the bearing body 31 in the radial direction of the rotating shaft 15. The end plate 32 is brought into contact with the upper surface of the first cylinder body 29*a* so as to cover the inner diameter part of the first cylinder body 29*a* from above.

The end plate 32 of the first bearing 19 is surrounded by a ring-shaped support member 33. The support member 33 is fixed to a predetermined position on the inner surface of the peripheral wall 10*a* of the sealed container 10 by, for example, means such as welding.

An outer peripheral part of the first cylinder body 29*a* which is the closest to the electric motor 11 is fixed to the lower surface of the support member 33 via a plurality of fastening bolts (only one fastening bolt shown).

The second bearing 20 is arranged below the second cylinder body 29*b*. The second bearing 20 includes a tubular bearing body 36 that rotatably supports the second journal portion 24*b* of the rotating shaft 15, and a flange-shaped end plate 37 extending from one end of the bearing body 36 in the radial direction of the rotating shaft 15. The end plate 37 is brought into contact with the lower surface of the second cylinder body 29*b* so as to cover the inner diameter part, of the second cylinder body 29*b* from below.

The end plate 32 of the first bearing 19, the first cylinder body 29*a*, the partition plate 17, the spacer IS, the second cylinder body 29*b*, and the end plate 37 of the second bearing 20 are overlaid in the axial direction of the rotating shaft 15, and are integrally connected via a plurality of fastening belts (not shown). Therefore, the first, bearing 19 and the second bearing 20 are separated in the axial direction of the rotating shaft 15.

As shown in FIG. 2, a first muffler cover 38 is provided on the first bearing 19. The first muffler cover 38 and the first bearing 19 cooperate with each other to define a first muffler chamber 39. The first muffler chamber 39 is opened inside the sealed container 10 through a plurality of exhaust holes (not shown) that the first muffler cover 38 includes.

A second muffler cover 40 is provided on the second bearing 20. The second muffler cover 40 and the second bearing 20 cooperate with each other to define a second muffler chamber 41. The second muffler chamber 41 communicates with the first muffler chamber 41 via a discharge passage (not shown) extending in the axial direction of the rotating shaft 15.

According to the present embodiment, a region surrounded by the inner diameter part of the first cylinder body 29*a*, the partition plate 17, and the end plate 32 of the first bearing 19 defines a first cylinder chamber 43. The first crank portion 23*a* of the rotating shaft 15 is accommodated in the first cylinder chamber 43.

A region surrounded by the inner diameter part of the second cylinder body 29*b*, the spacer 18, and the end plate 37 of the second bearing 20 defines a second cylinder chamber 44. The second crank portion 23*b* of the rotating shaft 15 is accommodated in the second cylinder chamber 44.

As shown in FIG. 2, a disk-shaped bearing hole 45 is opened at a central part of the partition plate 17. The intermediate Journal portion 24*c* of the rotating shaft 15 is slidably fitted in the bearing hole 45. This fitting allows the partition plate 17 to function as a bearing which supports the intermediate journal portion 24*c* of the rotating shaft 15.

In the present embodiment, the length of the axial direction of the bearing hole 45 is set to be longer than or equal to the length of the axial direction of the intermediate journal portion 24*c* of the rotating shaft 15.

The outer peripheral surface of the intermediate journal portion 24*c* and the inner peripheral surface of the bearing hole 45 are lubricated by lubricating oil stored in the sealed container 10. That is, the outer peripheral surface of the intermediate journal portion 24*c* and the inner peripheral surface of the bearing hole 45 are separated by an oil film of the lubricating oil, and most of the load applied to the intermediate journal portion 24*c* is received by an oil film reaction force when the rotating shaft 15 is rotated.

A circular through hole 49 is opened at a central part of the spacer 18. The through hole 43 is continuous with the bearing hole 45 and has an inner diameter larger than the bearing hole 45. The inner diameter of the through hole 43 is larger than the outer diameter of the second crank portion 23*b*. Furthermore, the intermediate shaft portion 25 of the rotating shaft 15 penetrates the through hole 46. An outer peripheral surface of the intermediate shaft portion 25 is separated from the inner peripheral surface of the through hole 43 without being in contact with the inner peripheral surface.

As shown in FIG. 2, a ring-shaped first roller 50 is fitted in the outer peripheral surface of the first crank portion 23*a*. The first roller 50 rotates eccentrically inside the first cylinder chamber 43, integrally with the rotating shaft 15, and a part of the outer peripheral surface of the first roller 50 is slidably in contact with the inner peripheral surface of the inner diameter part of the first cylinder body 29*a*.

An upper surface of the first roller 50 is slidably in contact with a lower surface of the end plate 32 of the first bearing 19. The lower surface of the first roller 50 is slidably in contact with the upper end surface of the partition plate 17 around the bearing hole 45. The airtightness of the first cylinder chamber 43 is thereby secured.

A ring-shaped second roller 51 is fitted in the outer peripheral surface of the second crank portion 23*b*. The second roller 51 rotates eccentrically inside the second cylinder chamber 44, integrally with the rotating shaft 15, and a part of the outer peripheral surface of the second roller 51 is slidably in contact with the inner peripheral surface of the inner diameter part of the second cylinder body 29*b*.

The upper surface of the second roller 51 is slidably in contact with the lower end surface of the spacer 18 around the through hole 48. A lower surface of the second roller 51 is slidably in contact with an upper surface of the end plate 37 of the second bearing 20. The airtightness of the second cylinder chamber 44 is thereby secured.

Figure 3:
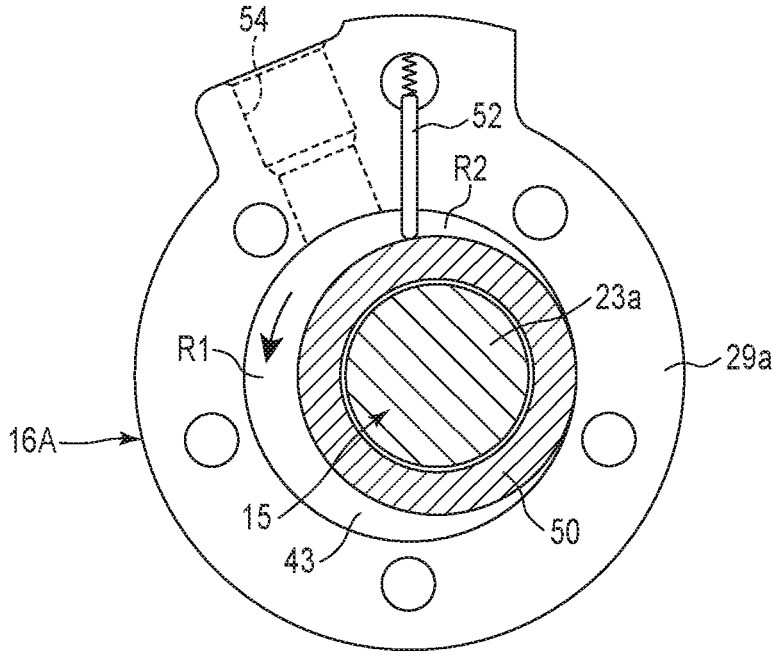
FIG. 3 is a cross-sectional view showing a positional relationship between a roller and a vane in a first cylinder chamber in the first embodiment.

As the first refrigerant compression unit 16A is shown as a representative in FIG. 3, a vane 52 is supported by the first cylinder body 29*a*. The vane 52 can move in the direction of advancing to the first cylinder chamber 43 or retreating from the first cylinder chamber 43, and a distal end of the vane 52 is slidably pressed against the outer peripheral surface of the first roller 50.

The vane 52 cooperates with the first roller 50 to partition the first cylinder chamber 43 into a suction region R1 and a compression region R2. For this reason, when the first roller 50 rotates eccentrically in the first cylinder chamber 43, the volumes of the suction region R1 and the compression region R2 of the first cylinder chamber 43 change continuously. Although not shown, the second cylinder chamber 44 is also divided into a suction region R1 and a compression region R2 by a similar vane.

As shown in FIG. 2 and FIG. 3, the first and second cylinder bodies 29*a* and 29*b* include suction ports 54 that open to the suction regions R1 of the first and second cylinder chambers 43 and 44, respectively. Furthermore, first and second connecting pipes 55*a* and 55*b* are connected to the suction ports 54 of the first and second cylinder bodies 29*a* and 29*b*. The first and second connecting pipes 55*a* and 55*b* penetrate the peripheral wall 10*a* of the sealed container 10 and protrude to the outside of the sealed container 10.

The accumulator 8 of the rotary compressor 2 is attached to the side of the sealed container 10 in a vertically standing posture. The accumulator 8 includes two branch pipes 56*a* and 56*b* that distribute the vapor-phase refrigerant from which the liquid-phase refrigerant is separated, to the first cylinder chamber 43 and the second cylinder chamber 44. The branch pipes 56*a* and 56*b* are made to protrude from the bottom of the accumulator 8 to the outside of the accumulator 8 and are airtightly connected to opening ends of the first and second connecting pipes 55*a* and 55*b*.

A first discharge port 57 is formed on the end plate 32 of the first bearing 19. The first discharge port 57 is opened into the first cylinder chamber 43 and the first muffler chamber 39. Furthermore, a reed valve 53 for opening and closing the first discharge port 57 is incorporated in the end plate 32 of the first bearing 19.

A second discharge port 59 is formed on the end plate 37 of the second bearing 20. The second discharge port 59 is opened into the second cylinder chamber 44 and the second muffler chamber 41. Furthermore, a reed valve 60 for opening and closing the second discharge port 59 is incorporated in the end plate 37 of the second bearing 20.

In such a two-cylinder rotary compressor 2, when the rotating shaft 15 is rotated by the electric motor 11, the first and second rollers 50 and 51 eccentrically rotate in the first and second cylinder chambers 43 and 44. As a result, the volumes of the suction region R1 and the compression region R2 of the first and second cylinder chambers 43 and 44 change, and the vapor-phase refrigerant in the accumulator 3 is sucked from the branch pipes 56*a* and 56*b* into the suction region R1 of the first and second cylinder chambers 43 and 44 via the first connecting pipe 55*a*, the second connecting pipe 55*b*, and the suction ports 54.

The vapor-phase refrigerant sucked into the suction region R1 of the first cylinder chamber 43 is compressed in the process in which the suction region R1 shifts to the compression region R2. When the pressure of the vapor-phase refrigerant reaches a predetermined value, the reed valve 58 is opened and the vapor-phase refrigerant compressed in the first cylinder chamber 43 is discharged from the first discharge port 57 into the first muffler chamber 39.

The vapor-phase refrigerant sucked into the suction region R1 of the second cylinder chamber 44 is compressed in the process in which the suction region R1 shifts to the compression region R2. When the pressure of the vapor-phase refrigerant reaches a predetermined value, the reed valve 60 is opened and the vapor-phase refrigerant compressed in the second cylinder chamber 44 is discharged from the second discharge port 59 into the second muffler chamber 41. The vapor-phase refrigerant discharged into the second muffler chamber 41 is guided to the first muffler chamber 39 through the discharge passage.

The vapor-phase refrigerant compressed in the first and second cylinder chambers 43 and 44 is continuously discharged from the first muffler chamber 39 into the sealed container 10 through the exhaust hole of the first muffler cover 38. The vapor-phase refrigerant discharged into the sealed container 10 passes through the electric motor 11 and then guided to the four-way valve 3 from the discharge pipe 10*b*.

Incidentally, in the two-cylinder rotary compressor 2 according to the present embodiment, the partition plate 17 which partitions the first cylinder chamber 43 and the second cylinder chamber 44 also functions as a bearing which supports the intermediate journal portion 24*c* of the rotating shaft 15.

For this reason, to engage the bearing hole 45 of the partition plate 17 with the intermediate journal portion 24*c*, it is necessary to insert the second journal portion 24*b* of the rotating shaft 15 into the bearing hole 45 of the partition plate 17 and then to move the partition plate 17 to the position of the intermediate journal portion 24*c* through the outside of the second crank portion 23*b* and the intermediate shaft portion 25.

Figure 4:
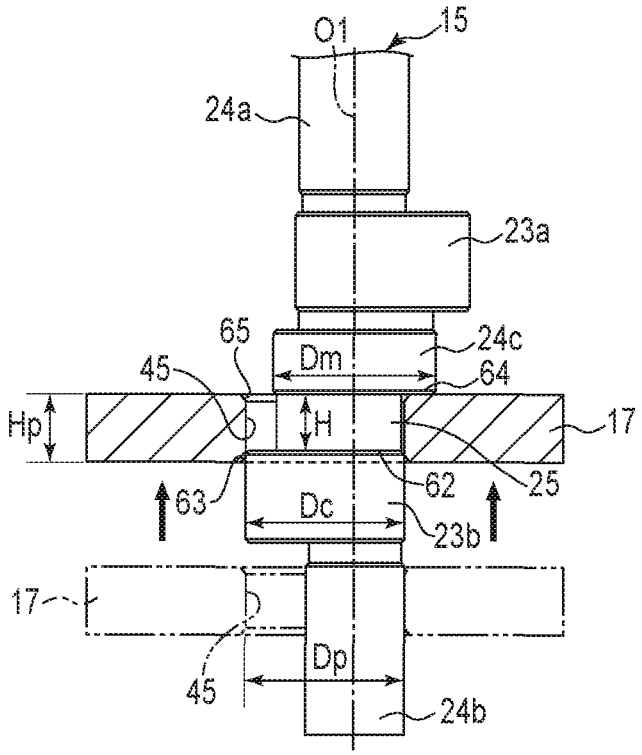
FIG. 4 is a cross-sectional view showing a state of moving a partition plate from a second journal portion of a rotating shaft to a position of an intermediate journal portion through an outside of a second crank portion, in the first embodiment.

That is, to engage the partition plate 17 with the intermediate journal portion 24*c* of the rotating shaft 15, first, the second journal portion 24*b* of the rotating shaft 15 is inserted into the bearing hole 45 of the partition plate 17 as represented by a two-dot chain line in FIG. 4. In this state, the partition plate 17 is moved in the axial direction of the rotating shaft 15 such that, the bearing hole 45 of the partition plate 17 passes outside the second crank portion 23*b* of the rotating shaft 15.

Since the inner diameter of the bearing hole 45 is larger than the outer diameter of the second crank portion 23*b* and the outer diameter of the intermediate shaft portion 25, the partition plate 17 can be moved to the position of the intermediate shaft portion 25 through the outside of the second crank portion 23*b*. FIG. 4 shows a state in which the partition plate 17 has been moved to the position of the intermediate shaft portion 25.

According to the present embodiment, the length in the axial direction of the bearing hole 45 corresponding to the thickness of the partition plate 17 is longer than the length in the axial direction of the intermediate shaft portion 25. Furthermore, the second crank portion 23*b* is eccentric to the intermediate journal portion 24*c* and the intermediate shaft portion 25. For this reason, although the partition plate 17 located at the position of the intermediate shaft portion 25 is to be moved in the radial direction of the rotating shaft 15 such that the bearing hole 45 is located coaxially with the intermediate journal portion 24*c*, an opening edge located on the side of the second crank portion 23*b*, of the bearing hole 45, interferes with the outer peripheral surface of the second crank portion 23*b*, and the partition plate 17 cannot be moved in the radial direction of the rotating shaft 15.

Figure 5:
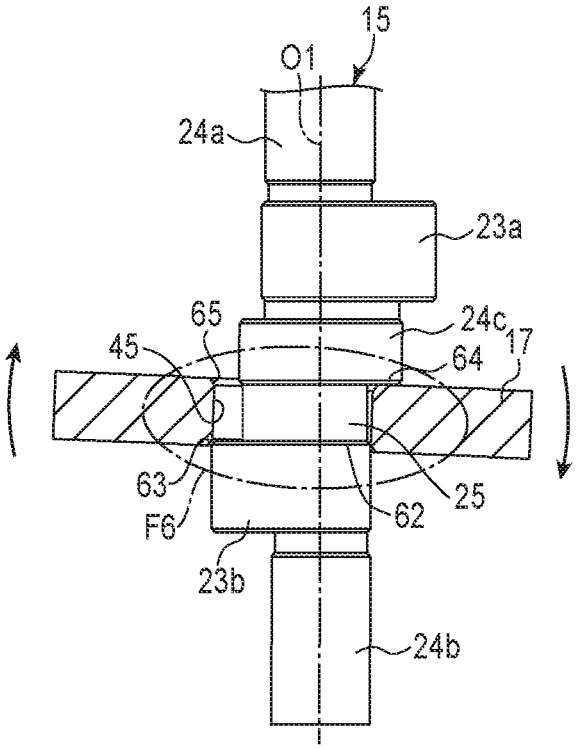
FIG. 5 is a cross-sectional view showing a state in which a partition plate is inclined between the second journal portion of the rotating shaft and the intermediate journal portion, in the first embodiment.
Figure 6:
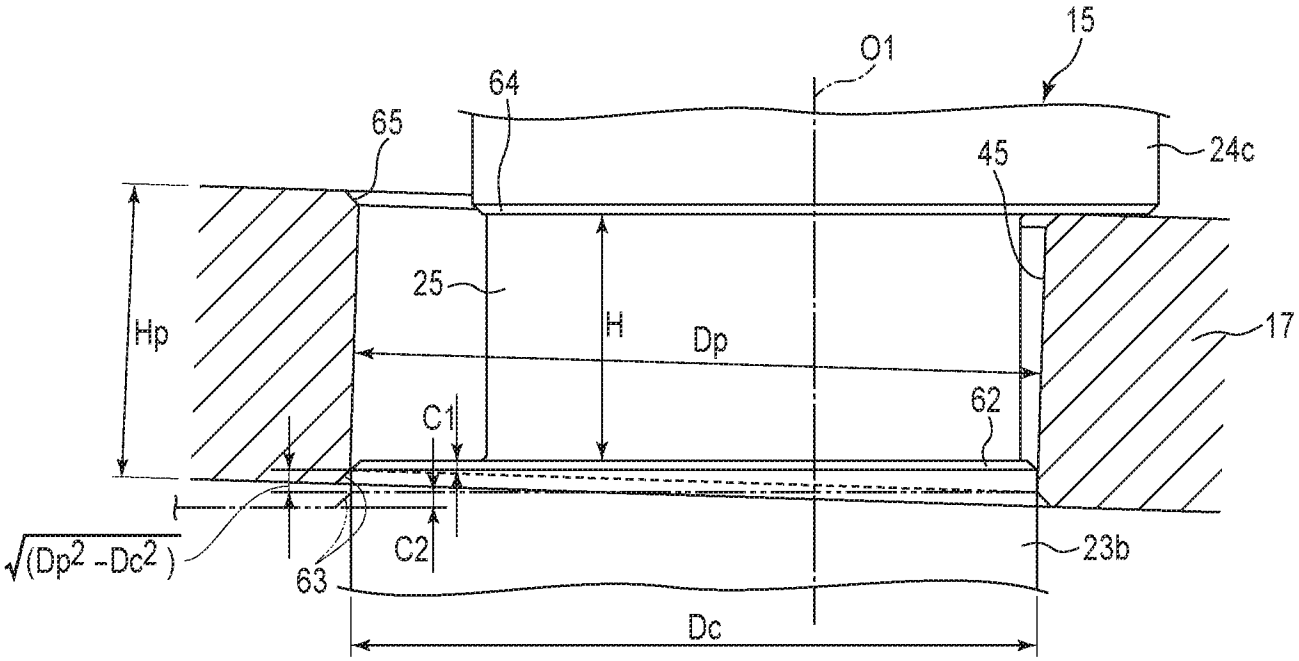
FIG. 6 is an enlarged cross-sectional view showing a portion of F6 in FIG. 5.

For this reason, as shown in FIG. 5 and FIG. 6, the partition plate 17 located at the position of the intermediate shaft portion 25 is inclined to the central axis O1 of the rotating shaft 15 such that the opening edge on the side of the second crank portion 23*b*, of the bearing hole 45, is displaced from the outer peripheral surface of the second crank portion 23*b*. The interference between the opening edge of the bearing hole 45 of the partition plate 17 and the outer peripheral surface of the second crank portion 23*b* is thereby avoided.

Figure 7:
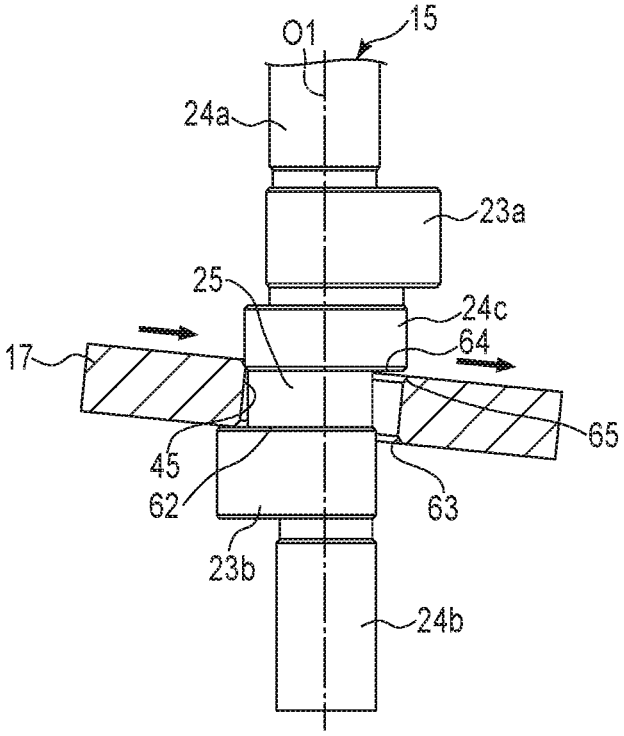
FIG. 7 is a cross-sectional view showing a state in which the partition plate is displaced between the second journal portion of the rotating shaft and the intermediate journal portion, in a radial direction of the rotating shaft, in the first embodiment.
Figure 8:
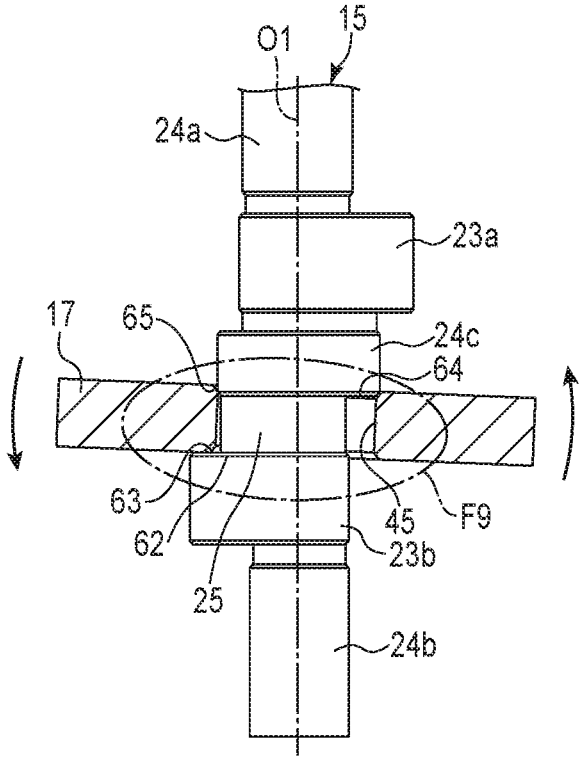
FIG. 8 is a cross-sectional view showing a state in which the partition plate is inclined between the second journal portion of the rotating shaft and the intermediate journal portion, in a direction opposite to the direction in FIG. 5, in the first embodiment.

In this state, as shown in FIG. 7, the partition plate 17 located at the position of the intermediate shaft portion 25 is moved in the radial direction of the rotating shaft 15 while inclined. Subsequently, as shown in FIG. 8 and FIG. 9, the partition plate 17 located at the position of the intermediate shaft portion 25 is moved in a direction opposite to that in FIG. 5, and the attitude of the partition plate 17 to the central axis O1 of the rotating shaft 15 is adjusted such that the bearing hole 45 of the partition plate 17 and the intermediate journal portion 24*c* are located coaxially.

Figure 10:
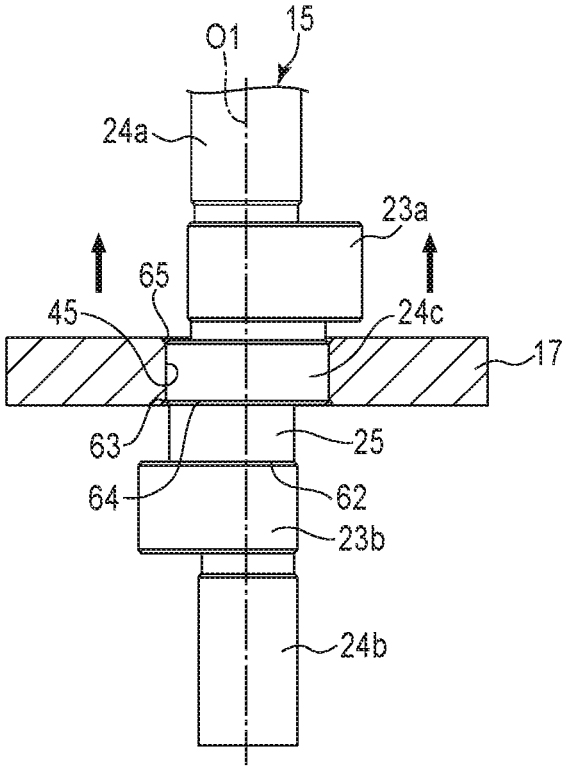
FIG. 10 is a cross-sectional view showing a state in which the intermediate journal portion of the rotating shaft is fitted in the bearing hole of the partition plate, in the first embodiment.

After that, as shown in FIG. 10, the partition plate 17 is moved in the axial direction of the rotating shaft 15, and the intermediate journal portion 24*c* of the rotating shaft 15 is slidably fitted in the bearing hole 45 of the partition plate 17. This fitting allows the intermediate journal portion 24*c* of the rotating shaft 15 to shift to the state of being supported by the bearing hole 45 of the partition plate 17, and the engagement of the partition plate 17 with the rotating shaft 15 is completed.

Figure 9:
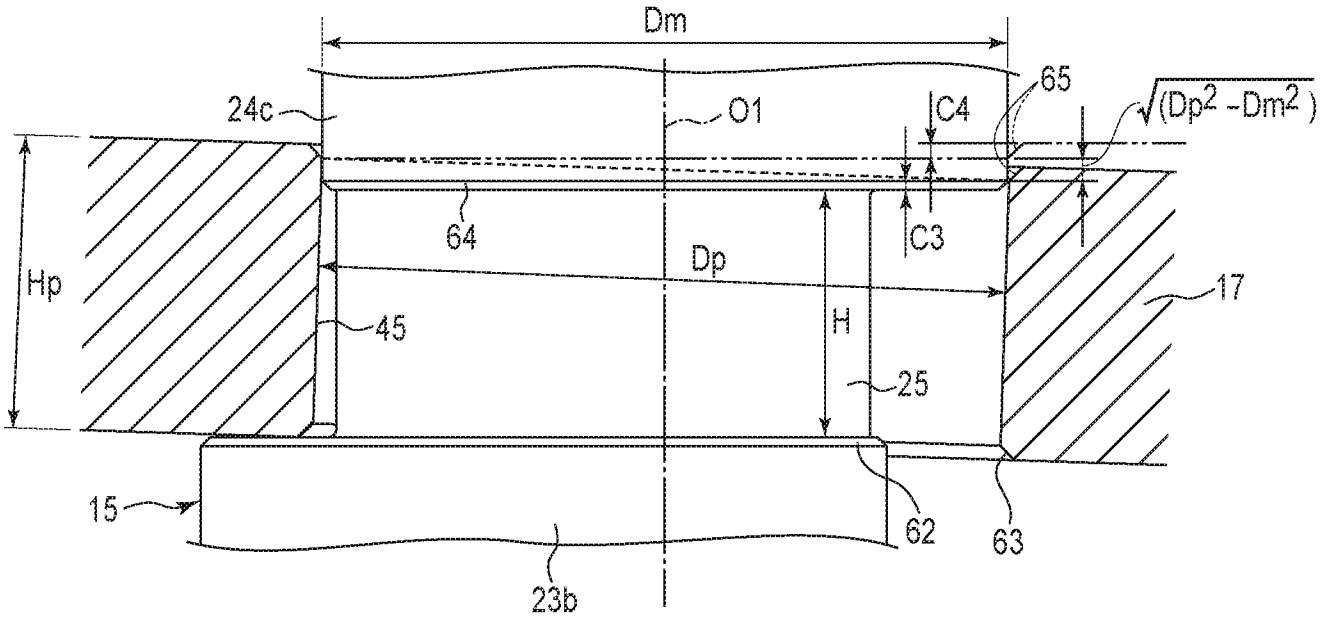
FIG. 9 is an enlarged cross-sectional view showing a portion of F9 in FIG. 8.

Incidentally, in the two-cylinder rotary compressor 2 of the present embodiment, a first chamfered portion 62 that is chamfered obliquely to the central axis O1 is formed at the edge located on the side of the intermediate shaft portion 25, of the second crank portion 23*b*, as most desirably shown in FIG. 6 and FIG. 9. Furthermore, a second chamfered portion 63 that is chamfered obliquely to the central axis O1 is formed at the opening edge located on the side of the second crank portion 23*b*, of the bearing hole 45.

In addition, a third chamfered portion 64 that is chamfered obliquely to the central axis O1 is formed at the edge located on the side of the intermediate shaft portion 25, of the intermediate journal portion 24*c*. Similarly, a fourth chamfered portion 65 that is chamfered obliquely to the central axis O1 is formed at the opening edge located on the side opposite to the second chamfered portion 63, of the bearing hole 45.

At this time, the length in the axial direction of the bearing hole 45 is longer than the length in the axial direction of the intermediate shaft portion 25. If the partition plate 17 is inclined as shown in FIG. 5 and FIG. 8, the second chamfered portion 63 and the fourth chamfered portion 65 of the bearing hole 45 may interfere with the first chamfered portion 62 of the second crank portion 23*b* and the third chamfered portion 64 of the intermediate journal portion 24*c*.

Thus, in the present embodiment, as shown in FIG. 4, FIG. 6 and FIG. 9, when the length in the axial direction of the intermediate shaft portion 25 of the rotating shaft 15 is referred to as H, the length in the axial direction of the bearing hole 45 of the partition plate 17 is referred to as Hp, the inner diameter of the bearing hole 45 of the partition plate 17 is referred to as Dp, the outer diameter of the second crank portion 23*b* adjacent to the second bearing 20 is referred to as Dc, and the outer diameter of the intermediate journal portion 24*c* of the rotating shaft 15 is referred to as Dm, Dp is set to be larger than Dc and Dm.

Furthermore, the dimensions of each portion of the rotating shaft 15 are defined so as to meet all relationships of the following equations (1), (2), and (3) when the axial length of the first chamfered portion 62 is referred to as C1, the axial length of the second chamfered portion 63 is referred to as C2, the axial length of the third chamfered portion 64 is referred to as C3, and the axial length of the fourth chamfered portion 65 is referred to as C4.

[Equation 1]

$$H \leq Hp \tag{1}$$

[Equation 2]

$$H > Hp - C1 - C2 - \sqrt{(Dp^2 - Dc^2)} \tag{2}$$

[Equation 3]

$$H > Hp - C3 - C4 - \sqrt{(Dp^2 - Dm^2)} \tag{3}$$

According to the first embodiment, since the intermediate journal portion 24*c* of the rotating shaft 13 is provided on the side closer to the first crank portion 23*a* at a position between the first crank portion 23*a* and the second crank portion 23*b*, the axial length of the intermediate journal portion 24*c* can be made longer. Moreover, since the length Hp in the axial direction of the bearing hole 45 exceeds the length H in the axial direction of the intermediate shaft portion 25, the axial length of the sliding portion of the intermediate journal portion 24*c* and the bearing hole 45 can be sufficiently secured.

For this reason, the lubricating oil lubricating the outer peripheral surface of the intermediate journal portion 24*c* and the inner peripheral surface of the bearing hole 45 that slide each other hardly flows out from between the intermediate journal portion 24*c* and the bearing hole 45, and the oil film of the lubricating oil which separates the outer peripheral surface of the intermediate journal portion 24*c* from the inner peripheral surface of the bearing hole 45 can be prevented from being broken.

Therefore, the lubrication of the intermediate journal portion 24*c* of the rotating shaft 15 can be improved, friction loss of the compression mechanism unit 12 can be reduced as much as possible, and the performance and the reliability of the two-cylinder rotary compressor 2 can be improved.

In addition, a gap corresponding to the length of the intermediate shaft portion 25 is formed between the intermediate journal portion 24*c* and the second crank portion 23*b*. For this reason, even if the axial length of the intermediate journal portion 24*c* is made slightly longer, the partition plate 17 moved to the position of the intermediate shaft portion 25 in the process of engaging the partition plate 17 with the rotating shaft 15 can be inclined to the central axis O1 of the rotating shaft 15 by using the gap.

In the present embodiment, the dimensions of each portion of the rotating shaft 15 are defined to satisfy the relationships (1) and (2). As a result, as shown in FIG. 5 and FIG. 6, when the partition plate 17 is inclined such that the second chamfered portion 63 of the bearing hole 45 is detached from the first chamfered portion 62 of the second crank portion 23*b*, a clearance of a size represented by a square root in FIG. 6 can be secured between the first chamfered portion 62 and the second chamfered portion 63 that are close to each other.

Therefore, interference between the second chamfered portion 63 of the bearing hole 45 and first chamfered portion 62 of the second crank portion 23*b* can be avoided, and the partition plate 17 located at the position of the intermediate shaft portion 25 can be moved in the radial direction of the rotating shaft 15.

Furthermore, in the present embodiment, the dimensions of each portion of the rotating shaft 15 are defined to satisfy the relationships (1) and (3). When the partition plate 17 is inclined such that the bearing hole 45 and the intermediate journal portion 24*c* are located coaxially as shown in FIG. 8 and FIG. 9, a clearance of a size represented by a square root in FIG. 9 can be secured between the third chamfered portion 64 and the fourth chamfered portion 65 that are close to each other.

For this reason, the interference between the fourth chamfered portion 65 of the bearing hole 45 and the third chamfered portion 64 of the intermediate journal portion 24*c* can be avoided, and the partition plate 17 located at the position of the intermediate shaft portion 25 can be moved toward the intermediate journal portion 24*c*.

Therefore, the partition plate 17 can be moved from the second journal portion 24*b* to the position of the intermediate journal portion 24*c* over the second crank portion 23*b* and the intermediate shaft portion 25 without difficulty, and the partition plate 17 can easily be engaged with the rotating shaft 15.

In addition, by satisfying ail the relationships (1), (2), and (3), the length H in the axial direction of the first intermediate shaft portion 25, and the inter-axial distance between intermediate journal portion 24*c* and the second crank portion 23*b* can be made as shorter as possible without damaging the workability of engaging the partition plate 17 with the rotating shaft 15.

As a result, increase of the full length of the rotating shaft 15 can be suppressed although the rotating shaft 15 includes the intermediate journal portion 24*c* between the first crank portion 23*a* and the second crank portion 23*b*. Therefore, the rotating shaft 15 can hardly be bent and the compact and highly reliable two-cylinder rotary compressor 2 can be provided.

According to the first embodiment, the spacer 18 is interposed between the partition plate 17 and the second cylinder body 29*b*, and the intermediate shaft portion 25 of the rotating shaft 15 penetrates the through hole 48 of the spacer 18. The second cylinder body 29*b* can move toward the second crank portion 23*b* by the thickness of the spacer 18, and the second crank portion 23*b* can be located in the center in the axial direction of the second cylinder body 29*b*, because of the presence of the spacer 18.

For this reason, larger volume and higher load of the second cylinder chamber 44 corresponding to the second cylinder body 29*b* can be implemented, which is desirable to improve the performance of the two-cylinder rotary compressor 2.

Furthermore, in the first embodiment, the outer diameter of the second crank portion 23*b* is smaller than the outer diameter of the first crank portion 23*a* and, accordingly, the inner diameter of the bearing hole 45 of the partition plate 17 can be made smaller. Thus, an area of contact between the bearing hole 45 and the intermediate journal portion 24*c* can be reduced and slide loss of the rotating shaft 15 can be reduced without damaging the property of engaging the partition plate 17 with the rotating shaft 15.

In addition, an advantage can be obtained that load of the first cylinder chamber 43 corresponding to the first crank portion 23*a* can be increased by making the outer diameter of the first crank portion 23*a* larger than the outer diameter of the second crank portion 23*b*, which contributes to improvement of the performance of the two-cylinder rotary compressor 2.

Second Embodiment

Figure 11:
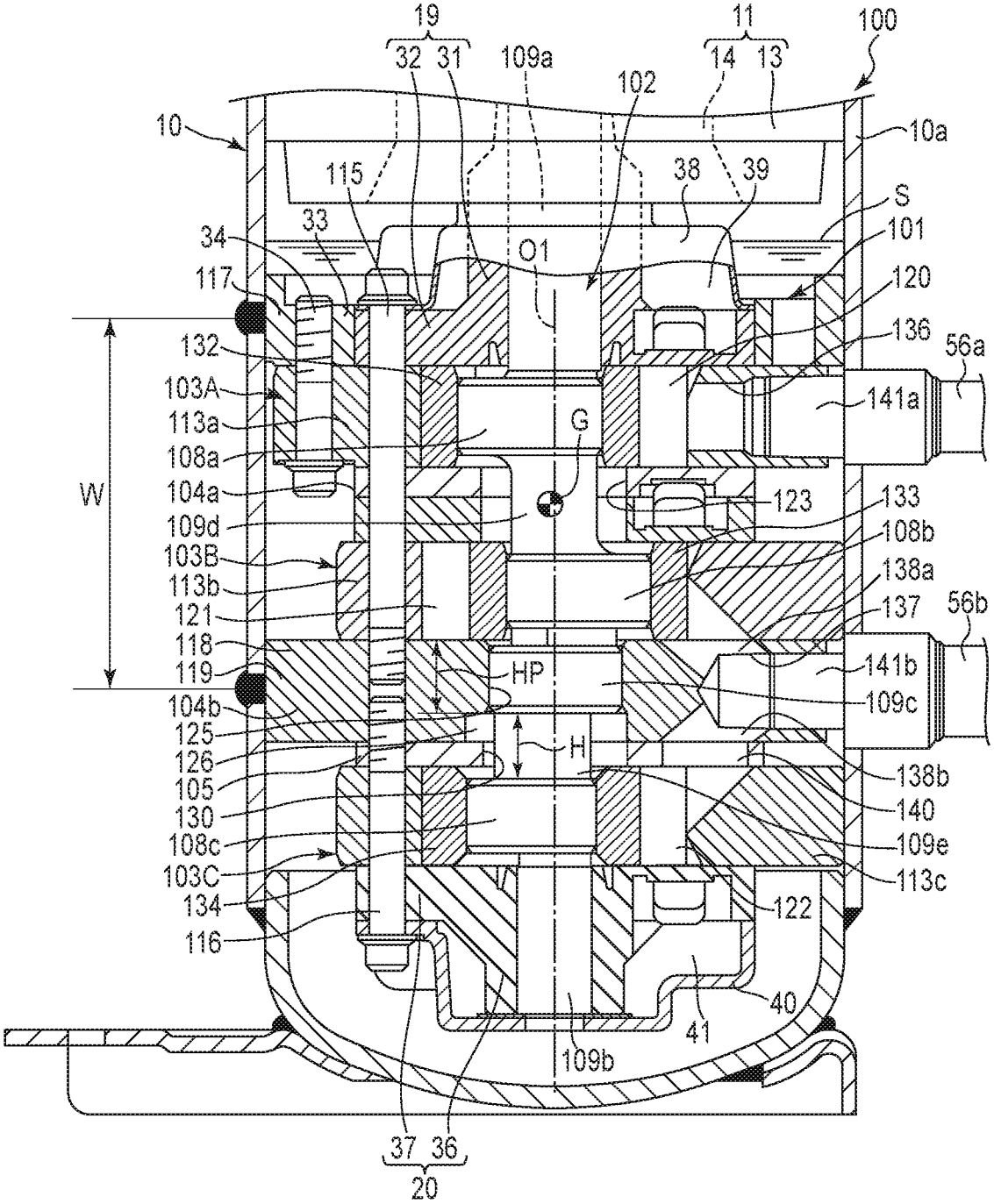
FIG. 11 is a cross-sectional view showing a three-cylinder rotary compressor according to the second embodiment.
Figure 12:
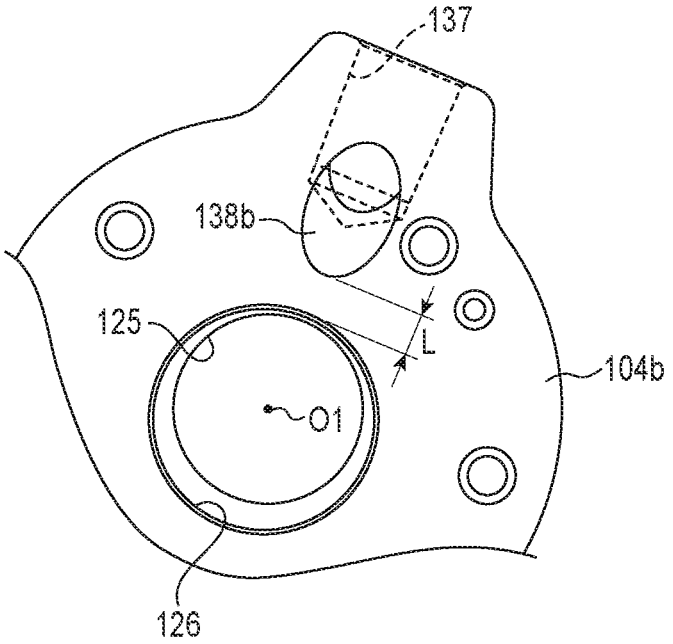
FIG. 12 is a diagram showing a lower surface of a second partition plate used at a compression mechanism unit of a second embodiment.

FIG. 11 and FIG. 12 disclose a second embodiment. The second embodiment discloses a vertical three-cylinder rotary compressor. A three-cylinder rotary compressor 100 is mainly different from the first embodiment with respect to a structure of a compression mechanism unit 101 accommodated in a sealed container 10. The basic configuration of the three-cylinder rotary compressor 100 other than this is the same as the two-cylinder rotary compressor 2 of the first, embodiment. For this reason, in the second embodiment, the same reference numerals are denoted to the same constituent portions as those in the first embodiment, and their descriptions will be omitted.

As shown in FIG. 11, the compression mechanism unit 101 comprises as main elements a rotating shaft 102, a first refrigerant compression unit 103A, a second refrigerant compression unit 103B, a third refrigerant compression unit 103C, a first partition plate 104*a*, a second partition plate 104*b*, and a spacer 105.

The rotating shaft 102 is located coaxially relative to the sealed container 10, and has a straight central axis O1 that is erected along the axial direction of the sealed container 10. The rotating shaft 102 includes a first journal portion 109*a* located at the upper part, a second journal portion 109*b* located at the lower end part, an intermediate journal portion 109*c* located between the first journal portion 109*a* and the second journal portion 109*b*, a first intermediate shaft portion 109*d* located between the intermediate journal portion 109*c* and the first journal portion 109*a*, a second intermediate shaft portion 109*e* located between the intermediate journal portion 109*c* and the second journal portion 109*b*, and first to third crank portions 108*a*, 108*b*, and 108*c*.

The rotating shaft 102 of the present embodiment is an integrated structure in which the plurality of elements are formed integrally, and upper end part of the first journal portion 109*a* is connected to the rotor 14 of the electric motor 11.

The first journal portion 109*a* and the second journal portion 109*b* are separated in the axial direction of the rotating shaft 102. The intermediate journal portion 109*c* is a disk-shaped element having a circular cross-section and has, for example, an outer diameter larger than the first journal portion 109*a* and the second journal portion 109*b*. The first journal portion 109*a*, the second journal portion 109*b*, the intermediate journal portion 109*c*, and the first intermediate shaft portion 109*d* are coaxially located on the central axis O1 of the rotating shaft 102.

Furthermore, the second intermediate shaft portion 109*e* is continuous with the intermediate journal portion 109*c* on the central axis O1 of the rotating shaft 102 and has an outer diameter smaller than the intermediate journal portion 109*c*.

The first to third crank portions 108*a*, 108*b*, and 108*c* are disk-shaped elements each having a circular cross-section, and are arranged at intervals in the axial direction of the rotating shaft 102. In addition, the first to third crank portions 108*a*, 108*b*, and 108*c* are eccentric with respect to the central axis O1 of the rotating shaft 102. The eccentric directions of the first to third crank portions 108*a*, 108*b*, and 108*c* with respect to the central axis O1 are deviated by, for example, 120 degrees in the circumferential direction of the rotating shaft 102.

The first crank portion 108*a* is interposed between the first journal portion 109*a* and the first intermediate shaft portion 109*d*. The second crank portion 108*b* is interposed between the first intermediate shaft portion 109*d* and the intermediate journal portion 109*c*. The third crank portion 108*c* is interposed between the second intermediate shaft portion 109*e* and the second journal portion 109*b*.

The first crank portion 108*a* and the second crank portion 108*b* have the outer diameters that are equal to each other and larger than the outer diameter of the intermediate journal portion 109*c*. The third crank portion 108*c* has the outer diameter that is smaller than the outer diameters of the first crank portion 108*a* and the second crank portion. 108*b* and larger than the outer diameter of the second intermediate shaft portion 109*e*.

According to the present embodiment, the intermediate journal portion 109*c* is provided at a position between the second crank portion 108*b* and the third crank portion 108*c*, which is closer to the second crank portion 108*b* side than the third crank portion 108*c*. For this reason, the intermediate journal portion 109*c* is separated from the third crank portion 108*c* by the distance corresponding to the axial length of the second intermediate shaft portion 109*e*.

In other words, the second intermediate shaft portion 109*e* straddles between the intermediate journal portion 109*c* and the third crank portion 108*c* to define a gap corresponding to the axial length of the second intermediate shaft portion 109*e* between the intermediate journal portion 109*c* and the third crank portion 108*c*.

As shown in FIG. 11, the first to third refrigerant compression units 103A, 103B, and 103C are arranged at intervals, in the axial direction of the rotating shaft 102, inside the sealed container 10. Each of the first to third refrigerant compression units 103A, 103B, and 103C includes a first cylinder body 113*a*, a second cylinder body 113*b*, and a third cylinder body 113*c*. The first to third cylinder bodies 113*a*, 113*b*, and 113*c* are set to have, for example, the same thickness along the axial direction of the rotating shaft 102.

The first partition plate 104*a* is interposed between the first cylinder body 113*a* and the second cylinder body 113*b*. An upper end surface of the first partition plate 104*a* is brought into contact with a lower surface of the first cylinder body 113*a* so as to cover the inner diameter part of the first cylinder body 113*a* from below. A lower end surface of the first partition plate 104*a* is brought into contact with an upper surface of the second cylinder body 113*b* so as to cover the inner diameter part of the second cylinder body 113*b* from above.

The second partition plate 104*b* is interposed between the second cylinder body 113*b* and the third cylinder body 113*c*. An upper end surface of the second partition plate 104*b* is brought into contact with a lower surface of the second cylinder body 113*b* so as to cover the inner diameter part of the second cylinder body 113*b* from below.

The spacer 105 is an element shaped in a flat disk and is interposed between the second partition plate 104*b* and the third cylinder body 113*c*. An upper end surface of the spacer 105 is brought into contact with a lower end surface of the second partition plate 104*b*. A lower end surface of the spacer 105 is brought into contact with an upper surface of the third cylinder body 113*c* so as to cover the inner diameter part of the third cylinder body 113*c* from above.

The first bearing 19 is arranged on the first cylinder body 113*a*. The end plate 32 of the first bearing 19 is brought into contact with the upper surface of the first cylinder body 113*a* so as to cover the inner diameter part of the first cylinder body 113*a* from above.

The second bearing 20 is arranged under the third cylinder body 113*c*. The end plate 37 of the second bearing 20 is brought into contact with the lower surface of the third cylinder body 113*c* so as to cover the inner diameter part of the third cylinder body 113*c* from below.

The end plate 32 of the first bearing 19, the first cylinder body 113*a*, the first partition plate 104*a*, the second cylinder body 113*b*, and the second partition plate 104*b* are overlaid in the axial direction of the rotating shaft 102, and are integrally connected via a plurality of fastening bolts 115 (only one shown).

The end plate 37 of the second bearing 20, the third cylinder body 113*c*, the spacer 105, and the second partition plate 104*b* are overlaid in the axial direction of the rotating shaft 102, and are integrally connected via a plurality of fastening bolts 116 (only one shown).

Therefore, the first bearing 19 and the second bearing 20 are separated in the axial direction, of the rotating shaft 102.

According to the present embodiment, the first cylinder body 113*a* which is the closest to the electric motor 11 is fixed to the sealed container 10 via the support member 33, similarly to the first embodiment. For this reason, the support member 33 fixed to the sealed container 10 constitutes a first fixing portion 117 that fixes the upper end part of the compression mechanism unit 101 to the sealed container 10.

Furthermore, the second partition plate 104*b* interposed between the second cylinder body 113*b* and the third cylinder body 113*c* includes a protruding portion 118 that protrudes from the outer peripheral part of the second partition plate 104*b* toward the inner surface of the peripheral wall 10*a* of the sealed container 10. The protruding portion 113 is made to protrude toward the inner surface of the peripheral wall 10*a* and is fixed to the sealed container 10 by means such as welding.

For this reason, the protruding portion 113 of the second partition plate 104*b* constitutes a second fixing portion 119 that directly fixes the intermediate part of the compression mechanism unit 101 to the sealed container 10. The first fixing portion 117 and the second fixing portion 119 are separated by a distance W in the axial direction of the sealed container 10.

According to the present embodiment, a region surrounded by the inner diameter part of the first cylinder body 113*a*, the upper end surface of the first partition plate 104*a*, and the end plate 32 of the first bearing 19 defines a first cylinder chamber 120. The first cylinder chamber 120 communicates with the first muffler chamber 39 via a first discharge port (not shown) that is opened and closed by a reed valve. The first crank portion 108*a* of the rotating shaft 102 is accommodated in the first cylinder chamber 120.

A region surrounded by the inner diameter part of the second cylinder body 113*b*, the lower end surface of the first partition plate 104*a*, and the upper end surface of the second partition plate 104*b* defines a second cylinder chamber 121. The first cylinder chamber 120 communicates with the first muffler chamber 39 via a discharge passage and a second discharge port (not shown) that is opened and closed by a reed valve. The second crank portion 108*b* of the rotating shaft 102 is accommodated in the second cylinder chamber 121.

A region surrounded by the inner diameter part of the third cylinder body 113*c*, the lower end surface of the spacer 105, and the end plate 37 of the second bearing 20 defines a third cylinder chamber 122. The third cylinder chamber 122 communicates with the second muffler chamber 41 via a third discharge port (not shown) that is opened and closed by a reed valve. The third crank portion 108*c* of the rotating shaft 102 is accommodated in the third cylinder chamber 122.

As shown in FIG. 11, a through hole 123 is formed at a central part of the first partition plate 104*a*. The through hole 123 is located between the first cylinder body 120 and the second cylinder body 121, and the first intermediate shaft portion 109*d* of the rotating shaft 102 penetrates the through hole 123.

According to the present embodiment, the second partition plate 104*b* has a thickness equal to, for example, the thicknesses of the first to third cylinder bodies 113*a*, 113*b*, and 113*c*. A circular bearing hole 125 and a relief recess portion 126 are formed at a central part of the second partition plate 104. The intermediate journal portion 109*c* of the rotating shaft 102 is slidably fitted in the bearing hole 125. This fitting allows the second partition plate 104*b* to function as a bearing which supports the intermediate journal portion 109*c* of the rotating shaft 102. The length of the axial direction of the bearing hole 125 is set to be longer than or equal to the length of the axial direction of the intermediate journal portion 109*c*.

The outer peripheral surface of the intermediate journal portion 109*c* and the inner peripheral surface of the bearing hole 125 are lubricated by the lubricating oil stored in the sealed container 10. That is, the outer peripheral surface of the intermediate journal portion 109*c* and the inner peripheral surface of the bearing hole 125 are separated by an oil film of the lubricating oil, and most of the load applied to the intermediate journal portion 109*c* is received by an oil film reaction force when the rotating shaft 102 is rotated.

The relief recess portion 126 is a circular element continuous with the bearing hole 125 and is opened to the lower end surface of the second partition plate 104*b* so as to point the third cylinder body 113*c*. Furthermore, the relief recess portion 126 has a shape larger than the inner diameter of the bearing hole 125 and the outer diameter of the third crank portion 108*c* and is eccentric to the bearing hole 125.

A circular through hole 130 is opened at a central part of the spacer 105. The through hole 130 is continuous with the relief recess portion 126 and has an inner diameter smaller than that of the relief recess portion 126. The inner diameter of the through hole 130 is larger than the outer diameter of the third crank portion 108*c*. Furthermore, the second intermediate shaft portion 109*e* of the rotating shaft 102 sequentially penetrates the relief recess portion 126 and the through hole 130.

A ring-shaped first roller 132 is fitted in the outer peripheral surface of the first crank portion 108*a*. The first roller 132 rotates eccentrically inside the first cylinder chamber 120, integrally with the rotating shaft 102, and a part of the outer peripheral surface of the first roller 132 is slidably in contact with the inner peripheral surface of the inner diameter part of the first cylinder body 113*a*.

An upper surface of the first roller 123 is slidably in contact with a lower surface of the end plate 32 of the first bearing 19. The lower surface of the first roller 123 is slidably in contact with the upper end surface of the first partition plate 104*a* around the through hole 123. The airtightness of the first cylinder chamber 120 is thereby ensured.

A ring-shaped second roller 133 is fitted in the outer peripheral surface of the second crank portion 108*b*. The second roller 133 rotates eccentrically inside the second cylinder chamber 121, integrally with the rotating shaft 102, and a part of the outer-peripheral surface of the second roller 133 is slidably in contact with the inner peripheral surface of the inner diameter part of the second cylinder body 113*b*.

The upper surface of the second roller 133 is slidably in contact with the lower end surface of the first partition plate 104*a* around the through hole 123. The lower surface of the second roller 133 is slidably in contact with the upper end surface of the second partition plate 104*b* around the bearing hole 123. The airtightness of the second cylinder chamber 121 is thereby ensured.

A ring-shaped third roller 134 is fitted in the outer peripheral surface of the third crank portion 108*c*. The third roller 134 rotates eccentrically inside the third cylinder chamber 122, integrally with the rotating shaft 102, and a part of the outer-peripheral surface of the third roller 134 is slidably in contact with the inner peripheral surface of the inner diameter part of the third cylinder body 113*c*.

The upper surface of the third roller 134 is slidably in contact with the lower end surface of the spacer 105 around the through hole 130. A lower surface of the third roller 134 is slidably in contact with an upper surface of the end plate 37 of the second bearing 20. The airtightness of the third cylinder chamber 122 is thereby ensured.

Furthermore, each of the first to third cylinder chambers 120, 121, and 122 is divided into a suction region and a compression region by the same vane (not shown) as that of the first embodiment. For this reason, when the first to third rollers 132, 133, and 134 rotate eccentrically in the first to third cylinder chambers 120, 121, and 122, the volumes of the suction region and the compression region of each of the cylinder chambers 120, 121, and 122 change continuously.

As shown in FIG. 11, the first cylinder body 113*a* includes a suction port 136 continuous with the suction region of the first cylinder chamber 120. The suction port 136 is opened to the outer peripheral surface of the first cylinder body 113*a*.

The second partition plate 104*b* comprises a suction port 137, and a first branch passage 136*a* and a second branch passage 138*b* branched from the suction port 137 in a bifurcated manner. The suction port 137 is opened to the outer peripheral surface of the second partition plate 104*b*. The first branch passage 138*a* is opened to the upper end surface of the second partition plate 104*b* so as to communicate with the suction region of the second cylinder chamber 121. The second branch passage 138*b* is opened to the lower end surface of the second partition plate 104*b* so as to direct the suction region of the third cylinder chamber 122.

As shown in FIG. 12, in the present embodiment, an open end of the relief recess portion 126 and the second branch passage 138*b* are located and arranged on the lower edge surface of the second partition plate 104*b*. The relief recess portion 126 is eccentric in the direction of being farther from the second branch passage 138*b* with respect to the central axis O1 of the rotating shaft 102.

For this reason, a distance L from the open end of the second branch passage 138*b* to the open end of the relief recess portion 126 can be secured on the lower end surface of the second partition plate 104*b*.

Furthermore, the spacer 105 interposed between the second partition plate 104*b* and the third cylinder body 113*c* includes a communication hole 140 at a position adjacent to the through hole 130. The communication hole 140 is opened to the upper end surface and the lower end surface of the spacer 105, and the open end of the second branch passage 138*b* and the suction region of the third cylinder chamber 122 are made to communicate with each other by the communication hole 140.

According to the present embodiment, since the relief recess portion 126 of the second partition plate 104*b* is eccentric in the direction of being farther from the second branch passage 138*b* with respect to the central axis O1 of the rotating shaft 102, the distance between the through hole 130 and the communication hole 140 can also be secured in the spacer 105 overlaid on the lower end surface of the second partition plate 104*b*.

For this reason, when the third roller 134 eccentrically rotates in the third cylinder chamber 122, the upper surface of the third roller 134 necessarily maintains a state of being slidably in surface contact with the lower end surface of the spacer 105 at a position between the through hole 130 and the communication hole 140.

Therefore, the airtightness of the third cylinder chamber 122 can be secured although the through hole 130 and the communication hole 140 in a state of being adjacent to each other are opened to the lower end surface of the spacer 105 exposed to the third cylinder chamber 122.

As shown in FIG. 11, a first connecting pipe 141*a* is connected to the suction port 136 of the first cylinder body 113*a*. A second connecting pipe 141*b* is connected to the suction port 137 of the second partition plate 104*b*. The first and second connecting pipes 141*a* and 141*b* penetrate the peripheral wall 10*a* of the sealed container 10 and protrude to the outside of the sealed container 10. The branch pipes 56*a* and 56*b* which the accumulator 3 includes are connected to the opening ends of the first and second connecting pipes 141*a* and 141*b* in an airtight state.

In such a three-cylinder rotary compressor 100, when the rotating shaft 102 of the compression mechanism unit 101 is rotated by the electric motor 11, the first to third rollers 132, 133, and 134 eccentrically rotate in the first to third cylinder chambers 120, 121, and 122.

The volumes of the suction regions and the compression regions of the first to third cylinder chambers 120, 121, and 122 change, and the vapor-phase refrigerant in the accumulator 8 is sucked from the branch pipes 56*a* and 56*b* into the suction regions of the first to third cylinder chambers 120, 121, and 122 via the first and second connecting pipes 141*a* and 141*b*.

More specifically, the vapor-phase refrigerant sucked from the first connecting pipe 141*a* into the suction region of the first cylinder chamber 120 through the suction port 136 is compressed in the process of shifting the suction region to the compression region. When the pressure of the vapor-phase refrigerant reaches a predetermined value, the first discharge port is opened and the vapor-phase refrigerant compressed in the first cylinder chamber 120 is discharged into the first muffler chamber 39.

Part of the vapor-phase refrigerant guided from the second connecting pipe 141*b* to the suction port 137 of the second partition plate 104*b* is sucked into the suction region of the second cylinder chamber 121 through the first branch passage 138*a* and is compressed in the process of shifting the suction region to the compression region. When the pressure of the vapor-phase refrigerant reaches a predetermined value, the second discharge port is opened and the vapor-phase refrigerant compressed in the second cylinder chamber 121 is guided to the first muffler chamber 39 through the discharge passage.

The remaining vapor-phase refrigerant guided from the second connecting pipe 141*b* to the suction port 137 of the second partition plate 104*b* is sucked into the suction region of the third cylinder chamber 122 through the second branch passage 138*b* and is compressed in the process of shifting the suction region to the compression region. When the pressure of the vapor-phase refrigerant reaches a predetermined value, the third discharge port is opened and the vapor-phase refrigerant compressed in the third cylinder chamber 122 is discharged into the second muffler chamber 41. The vapor-phase refrigerant discharged into the second muffler chamber 41 is guided to the first muffler chamber 39 through the discharge passage.

The eccentric directions of the first to third crank portions 108*a*, 108*b*, and 108*c* of the rotating shaft 102 are displaced by 120 degrees in the circumferential direction of the rotating shaft 102. For this reason, an equivalent phase difference is made at the timing at which the vapor-phase refrigerants compressed in the first to third cylinder chambers 120, 121, and 122 are discharged.

The vapor-phase refrigerants compressed in the first to third cylinder chambers 120, 121, and 122 are continuously discharged from the first muffler chamber 39 into the sealed container 10 through the exhaust hole of the first muffler cover 38. The vapor-phase refrigerant discharged into the sealed container 10 passes through the electric motor 11 and then guided to the four-way valve 3 from the discharge pipe 10*b*.

In the three-cylinder rotary compressor 100 of the present embodiment, the first cylinder body 113*a* located at the upper end part of the compression mechanism unit 101 is fixed to the sealed container 10 by the first fixing portion 117, and the second partition plate 104*b* interposed between the second cylinder body 113*b* and the third cylinder body 113*c* is fixed to the sealed container 10 by the second fixing portion 119. For this reason, the compression mechanism unit 101 is fixed to the sealed container 10 at two parts separated in the axial direction of the rotating shaft 102.

Furthermore, in the present embodiment, the center of gravity G of the structure including the rotor 14 of the electric motor 11 and the compression mechanism unit 101 is located within the range of the distance H between the first fixing portion 117 and the second fixing portion 119 by, for example, optimizing the weight, distribution of various components constituting the compression mechanism unit 101.

More specifically, as shown in FIG. 11, the center of gravity G is located on the axis of the first intermediate shaft portion 109*d* which straddles between the first crank portion 108*a* and the second crank portion 108*b*.

In contrast, in the three-cylinder rotary compressor 100 according to the present embodiment, the second partition plate 104*b* which partitions the second cylinder chamber 121 and the third cylinder chamber 122 also functions as a bearing which supports the intermediate journal portion 109*c* of the rotating shaft 102.

For this reason, to engage the bearing hole 125 of the second partition plate 104*b* with the intermediate journal portion 109*c*, it is necessary to insert the second journal portion 109*b* of the rotating shaft 102 into the bearing hole 125 of the second partition plate 104*b* and then to move the second partition plate 104*b* to the position of the intermediate journal portion 109*c* through the outside of the third crank portion 108*c* and the second intermediate shaft portion 109*e*.

That is, the second partition plate 104*b* is moved in the axial direction of the rotating shaft 102 such that the bearing hole 125 of the second partition plate 104*b* passes outside the third crank portion 108*c* of the rotating shaft 102, in a state in which the second journal portion 109*b* of the rotating shaft 102 is inserted into the bearing hole 125 of the second partition plate 104*b*.

Since the inner diameter of the bearing hole 125 is larger than the outer diameters of the third crank portion 108*c* and the second intermediate shaft portion 109*e*, the second partition plate 104*b* can be moved to the position of the second intermediate shaft portion 109*e* through the outside of the third crank portion 108*c*.

According to the present embodiment, the length in the axial direction of the bearing hole 125 is longer than the length in the axial direction of the second intermediate shaft portion 109*e*. Furthermore, the third crank portion 108*c* is eccentric to the intermediate journal portion 109*c* and the second intermediate shaft portion 109*e*.

For this reason, although the second partition plate 104*b* moved to the position of the second intermediate shaft portion 109*e* is to be moved in the radial direction of the rotating shaft 102 such that the bearing hole 125 is located coaxially with the intermediate journal portion 109*c*, an opening edge located on the side of the third crank portion 108*c*, of the bearing hole 125, interferes with the outer peripheral surface of the third crank portion 108*c*, and the second partition plate 104*b* cannot be moved in the radial direction of the rotating shaft 102.

In other words, the bearing hole 125 and the third crank portion 108*c* of the second embodiment are maintained in the same positional relationship as that between the bearing hole 45 and the second crank portion 23*b* of the first embodiment, in the state in which the second partition plate 104*b* is moved to the position of the second intermediate shaft portion 109*e*.

Therefore, the second partition plate 104*b* located at the position of the second intermediate shaft portion 109*e* is inclined to the central axis O1 of the rotating shaft 102 such that the opening edge on the side of the third crank portion 108*c*, of the bearing hole 125, is displaced from the outer peripheral surface of the third crank portion 108*c*, similarly to FIG. 5 of the first embodiment.

At this time, the second partition plate 104*b* includes a relief recess portion 126 continuous with the bearing hole 125, and the relief recess portion 126 has a shape larger than the outer diameter of the third crank portion 108*c* and is opened to the lower end surface of the second partition plate 104*b*. For this reason, when the second partition plate 104*b* located at the position of the second intermediate shaft portion 109*e* is inclined, the third crank portion 108*c* enters inside the relief recess portion 126.

Thus, the second partition plate 104*b* can be inclined and the interference between the inner peripheral surface of the bearing hole 125 and the outer peripheral surface of the third crank portion 108*c* can be avoided, irrespective of the thickness of the second partition plate 104*b* being longer than the length in the axial direction of the bearing hole 125.

In this state, the second partition plate 104*b* located at the position of the second intermediate shaft portion 109*e* is moved in the axial direction of the rotating shaft 102 while inclined. Subsequently, the second partition plate 104*b* located at the position of the second intermediate shaft portion 109*e* is inclined in an opposite direction, and the attitude of the second partition plate 104*b* to the central axis O1 of the rotating shaft 102 is adjusted such that the bearing hole 125 of the second partition plate 104*b* and the intermediate journal portion 109*c* are located coaxially, similarly to FIG. 8 of the first embodiment.

After that, the second partition plate 104*b* is moved in the axial direction of the rotating shaft 102, and the intermediate journal portion 109*c* is fitted in the bearing hole 125 of the second partition plate 104*b*. This fitting allows the intermediate journal portion 109*c* of the rotating shaft 102 to shift to the state of being supported by the bearing hole 125 of the second partition plate 104*b*, and the engagement of the second partition plate 104*b* with the rotating shaft 102 is completed.

Figure 13A:
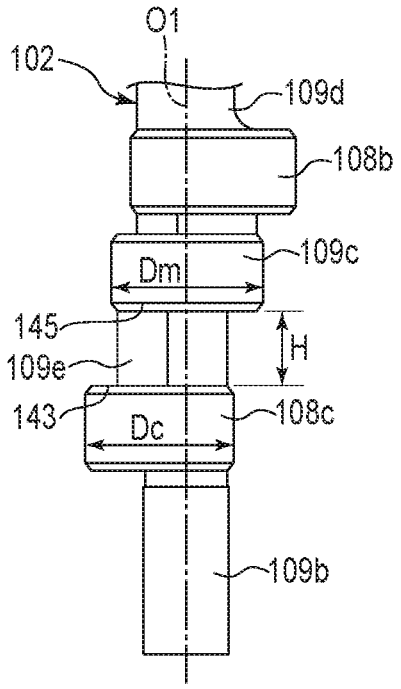
FIG. 13A is a side view showing a relationship in dimension among the intermediate journal portion of the rotating shaft, a third crank portion, and a second intermediate shaft portion, in the second embodiment.
Figure 13B:
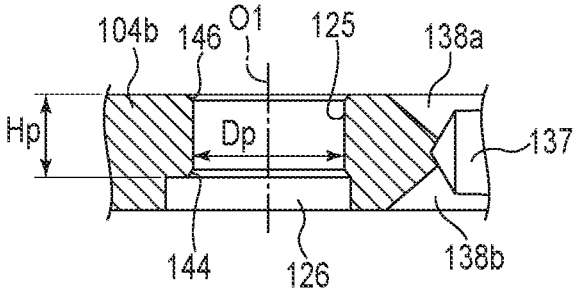
FIG. 13B is a cross-sectional view showing dimensions of a bearing hole of a second partition plate, in the second embodiment.

Incidentally, in the three-cylinder rotary compressor 100 of the present embodiment, a first chamfered portion 143 that is chamfered obliquely to the central axis O1 is formed at the edge located on the side of the second intermediate shaft portion 109*e*, of the third crank portion 108*c*, as shown in FIG. 13A and FIG. 13B. Furthermore, a second chamfered portion 144 that is chamfered obliquely to the central axis O1 is formed at the opening edge located on the side of the third crank portion 108*c*, of the bearing hole 125.

In addition, a third chamfered portion 145 that is chamfered obliquely to the central axis O1 is formed at the edge located on the side of the second intermediate shaft portion 109*e*, of the intermediate journal portion 109*c*. Similarly, a fourth chamfered portion 146 that is chamfered obliquely to the central axis O1 is formed at the opening edge located on the side opposite to the second chamfered portion 144, of the bearing hole 125.

At this time, the length in the axial direction of the bearing hole 125 is longer than the length in the axial direction of the second intermediate shaft portion 109*e*. When the second partition plate 104*b* is inclined as described above, the second chamfered portion 144 and the fourth chamfered portion 146 of the bearing hole 125 may interfere with the first chamfered portion 143 of the third crank, portion 108*c* and the third chamfered portion 145 of the intermediate journal portion 109*c*.

For this reason, in the present embodiment, too, similarly to the first embodiment, Dp is set to be larger than Dc and Dm where the length in the axial direction of the second intermediate shaft portion 109*e* of the rotating shaft 102 is referred to as H, the length in the axial direction of the bearing hole 125 of the second partition plate 104*b* is referred to as Hp, the inner diameter of the bearing hole 125 of the second partition plate 104*b* is referred to as Dp, the outer diameter of the third crank portion 108*c* adjacent to the second bearing 20 is referred to as Dc, and the outer diameter of the intermediate journal portion 109*c* of the rotating shaft 102 is referred to as Dm.

In addition, similarly to the first embodiment, the dimensions of each portion of the rotating shaft 102 are defined so as to satisfy all relationships of the following equations (1), (2), and (3) when the length in the axial direction of the first chamfered portion 143 is referred to as C1, the length in the axial direction of the second chamfered portion 144 is referred to as C2, the length in the axial direction of the third chamfered portion 145 is referred to as C3, and the length in the axial direction of the fourth chamfered portion 146 is referred to as C4.

According to the second embodiment, since the intermediate journal portion 109*c* of the rotating shaft 102 is provided on the side closer to the second crank portion 108*b* at the position between the second crank portion 108*b* and the third crank portion 108*c*, the axial length of the intermediate journal portion 109*c* can be made longer. Moreover, since the length Hp in the axial direction of the bearing hole 125 exceeds the length H in the axial direction of the second intermediate shaft portion 109*e*, the axial length of the sliding portion of the intermediate journal portion 109*c* and the bearing hole 125 can be sufficiently secured.

For this reason, the lubricating oil lubricating the outer peripheral surface of the intermediate journal portion 109*c* and the inner peripheral surface of the bearing hole 125 that slide on each other hardly flows out from between the intermediate journal portion 109*c* and the bearing hole 125, and the lubrication of intermediate journal portion 109*c* of the rotating shaft 102 can be improved. Therefore, the friction loss of the compression mechanism unit 101 can be reduced as much as possible, and the performance and the reliability of the three-cylinder rotary compressor 100 can be improved.

In addition, a gap corresponding to the length of the second intermediate shaft portion 109*e* is formed between the intermediate journal portion 109*c* and the third crank portion 108*c*. For this reason, even if the axial length of the intermediate journal portion 109*c* is made slightly longer, the second partition plate 104*b* moved to the position of the second intermediate shaft portion 109*e* in the process of engaging the second partition plate 104*b* with the rotating shaft 102 can be inclined to the central axis O1 of the rotating shaft 102 by using the gap.

In the present embodiment, the dimensions of each portion of the rotating shaft 102 are defined to satisfy the relationships (1) and (2). When the second partition plate 104*b* is inclined such that the second chamfered portion 144 of the bearing hole 125 is detached from the first chamfered portion 143 of the third crank portion 108*c*, a clearance of the same size as that of the first embodiment can be secured between the first chamfered portion 143 and the second chamfered portion 144 that are close to each other.

For this reason, the interference between the second chamfered portion 144 of the bearing hole 125 and the first chamfered portion 143 of the third crank portion 108*c* can be avoided, and the second partition plate 104*b* located at the position of the second intermediate shaft portion 109*e* can be moved in the radial direction of the rotating shaft 102.

Furthermore, in the present embodiment, the dimensions of each portion of the rotating shaft 102 are defined to satisfy the relationships (1) and (3). When the second partition plate 104*b* is inclined such that the bearing hole 125 and the intermediate journal portion 109*c* are located coaxially, a clearance of the same size as that of the first embodiment can be secured between the third chamfered portion 145 and the fourth chamfered portion 146 that are close to each other.

For this reason, the interference between the fourth chamfered portion 146 of the bearing hole 125 and the third chamfered portion 145 of the intermediate journal portion 109*c* can be avoided, and the second partition plate 104*b* located at the position of the second intermediate shaft portion 109*e* can be moved toward the intermediate journal portion 109*c*.

Therefore, the second partition plate 104*b* can be moved from the second journal portion 24*b* to the position of the intermediate journal portion 109*c* over the third crank portion 108*c* and the second intermediate shaft portion 109*e* without difficulty, and the second partition plate 104*b* can easily be engaged with the rotating shaft 102.

In addition, by satisfying all the relationships (1), (2), and (3), the length in the axial direction of the second intermediate shaft portion 109*e*, and the inter-axial distance between intermediate journal portion 109*c* and the third crank portion 108*c* can be made as shorter as possible without damaging the workability of engaging the second partition plate 104*b* with the rotating shaft 102.

As a result, increase of the full length of the rotating shaft 102 can be suppressed although the rotating shaft 102 includes the intermediate journal portion 109*c* between the second crank portion 108*b* and the third crank portion 108*c*. Therefore, the rotating shaft 102 can hardly be bent and the compact and highly reliable three-cylinder rotary compressor 100 can be provided.

In addition, according to the second embodiment, the second partition plate 104*b* including the bearing hole 125 comprises the relief recess portion 126 continuous with the bearing hole 125. The relief recess portion 126 is opened to the lower end surface of the second partition plate 104*b* located on the side of the third crank portion 108*c* and has a shape larger than the outer diameter of the third crank portion 108*c*.

According to this configuration, since the second partition plate 104*b* incorporates the suction port 137, the first branch passage 138*a*, and the second branch passage 138*b* that distribute the vapor-phase refrigerant to the second cylinder chamber 121 and the third cylinder chamber 122, the interference of the second partition plate 104*b* with the third crank portion 108*c* can be avoided when the second partition plate 104*b* is engaged with the rotating shaft 102, even if the second partition plate 104*b* becomes thicker.

Therefore, the second partition plate 104*b* can be engaged with the rotating shaft 102 without extending the interval between the intermediate journal portion 109*c* and the third crank portion 108*c*. As a result, the workability of engaging the second partition plate 104*b* with the rotating shaft 102 is not damaged. In addition, the interval between the intermediate journal portion 109*c* and the third crank portion 108*c* can be made as small as possible, and the three-cylinder rotary compressor 100 can be designed in a compact size.

Furthermore, since the suction port 137 to which the branch pipe 56*b* is connected, and the first branch passage 138*a* and the second branch passage 138*b* branched from the suction port 137 to the second cylinder chamber 121 and the third cylinder chamber 122 are provided inside the second partition plate 104*b* including the bearing hole 125, the second partition plate 104*b* becomes inevitably thicker in the axial direction of the rotating shaft 102.

As a result, the configuration is advantageous in securing the length in the axial direction of the bearing hole 125, and the inner diameter of the suction port 137 can be made as large as possible. Therefore, the suction loss of the vapor-phase refrigerant can be suppressed to a low level, which is advantageous to improve the performance of the three-cylinder rotary compressor 100.

According to the second embodiment, the spacer 105 is interposed between the second partition plate 104*b* and the third cylinder body 113*c*, and the second intermediate shaft portion 109*e* of the rotating shaft 102 penetrates the through hole 130 of the spacer 105. The presence of the spacer 105 allows the third cylinder body 113*c* to move in the direction of the third crank portion 108*c* by the thickness of the spacer 105 and allows the third crank portion 108*c* to be located at the central part in the axial direction of the third cylinder body 113*c*.

For this reason, larger volume and higher load of the third cylinder chamber 122 corresponding to the third cylinder body 113*c* can be implemented, and the performance of the three-cylinder rotary compressor 100 can be improved.

Furthermore, the outer diameter of the third crank portion 108*c* is smaller than the outer diameters of the first and second crank portions 108*a* and 108*b* and, accordingly, the inner diameter of the bearing hole 125 of the second partition plate 104*b* can be made smaller. For this reason, an area of contact between the bearing hole 125 and the intermediate journal portion 109*c* can be reduced and slide loss of the rotating shaft 102 can be reduced without damaging the property of engaging the second partition plate 104*b* with the rotating shaft 102.

In addition, load of the first and second cylinder chambers 120 and 121 corresponding to the first and second crank portions 108*a* and 108*b* can be increased by making the outer diameters of the first and second crank portions 108*a* and 108*b* larger than the outer diameter of the third crank portion 108*c*, which contributes to improvement of the performance of the three-cylinder rotary compressor 100.

According to the second embodiment, since the second partition plate 104*b* which partitions the second cylinder chamber 121 and the third cylinder chamber 122 is fixed to the inner surface of the peripheral wall 10*a* of the sealed container 10, the distance from the second cylinder chamber 121 and the third cylinder chamber 122 receiving the centrifugal force and the compression load when compressing the vapor-phase refrigerant to the fixed position of the second partition plate 104*b* becomes shorter.

Thus, the moment acting on the fixed position of the second partition plate 104*b* can be suppressed to a small value and the stress generated on the fixed position of the second partition plate 104*b* can be reduced. As a result, displacement, inclination, etc., of the second partition plate 104*b* to the sealed container 10 can be prevented, and the compression mechanism unit 101 can be held at a predetermined position of the sealed container 10 with a good accuracy.

Furthermore, the center in the diameter direction of the sealed container 10 can easily be made coincident with the central axis O1 of the rotating shaft 102 by fixing the second partition plate 104*b* which receives the intermediate journal portion 109*c* of the rotating shaft 102 to the sealed container 10.

Moreover, since the stator 13 of the electric motor 11 which rotates the rotating shaft 102 is fixed to the inner surface of the peripheral wall 10*a* of the sealed container 10, the coaxial degree between the electric motor 11 and the rotating shaft 102 can be determined with a good accuracy and the air gap between the stator 13 and the rotor 14 of the electric motor 11 can be made uniform. The low noise and high performance three-cylinder rotary compressor 100 can be thereby obtained.

In addition, in the three-cylinder rotary compressor 100 according to the second embodiment, the center of gravity G of the structure including the rotor 14 of the electric motor 11 and the compression mechanism unit 101 is located on the first intermediate shaft portion 109*d* which straddles between the first crank portion 108*a* and the second crank portion 108*b*, within the range of the distance W between the first fixing portion 117 and the second fixing portion 119.

According to this configuration, when the vapor-phase refrigerant is compressed in the compression mechanism unit 101, the pressure fluctuation occurs in three places, i.e., the first to third cylinder chambers 120, 121, and 122, but occurrence of large variations in the distance from the three places where the pressure fluctuation occurs to the center of gravity G can be avoided. Therefore, the compression mechanism unit 101 which is one of the vibration generation sources can be firmly supported by the sealed container 10 and vibration of the compression mechanism unit 101 can be suppressed.

Therefore, the highly reliable three-cylinder rotary compressor 100 suppressing the vibration which causes noise and various troubles can be provided.

In the above embodiments, the two-cylinder rotary compressor and the three-cylinder rotary compressor have been described. The embodiments can also be applied to, for example, a multi-cylinder rotary compressor including four or more cylinder chambers.

The rotary compressor is not limited to the vertical type rotary compressor in which the rotating shaft stands, but may be a lateral type rotary compressor in which the rotating shaft is arranged in a landscape position.

Furthermore, in the above embodiments, an example of a general rotary compressor in which the vane advances in the cylinder chamber while following the eccentric rotation of the roller or moves in the direction of retreating from the cylinder chamber has been described. However, the embodiments can also be applied to, for example, a so-called swing-type rotary compressor in which the vane is made to integrally protrude from the outer peripheral surface of the roller toward the radial outer side of the roller.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit, of the inventions. The accompanying claims and their equivalents are intended to cover such forms or modifications as would fall within the scope and spirit, of the inventions.

What is claimed is:

1. A rotary compressor comprising:

a sealed container;

a compression mechanism unit accommodated in the sealed container to compress a working fluid; and a drive source driving the compression mechanism unit, the compression mechanism unit including:

a rotating shaft connected to the drive source;

a first bearing and a second bearing rotatably supporting the rotating shaft;

a plurality of cylinder bodies interposed between the first bearing and the second bearing, and spaced apart and arranged in an axial direction of the rotating shaft, and defining cylinder chambers, respectively; and a partition plate provided between the adjacent cylinder bodies and including a bearing hole, the rotating shaft including:

a first journal portion supported by the first hearing;

a second journal portion supported by the second bearing;

a plurality of disk-shaped crank portions located between the first journal portion and the second journal portion and accommodated in the cylinder chambers;

an intermediate journal portion provided at a position closer to a side of one of the crank portions, between the crank portions adjacent in the axial direction of the rotating shaft, and slidably supported by the bearing hole of the partition plate; and an intermediate shaft portion straddling between the other crank portion adjacent to the second bearing and the intermediate journal portion, and having a diameter smaller than the intermediate journal portion, wherein the compression mechanism unit further includes a spacer interposed between the partition plate and the cylinder body corresponding to the other crank portion adjacent to the second bearing, the intermediate shaft portion of the rotating shaft penetrates the spacer, when a length in the axial direction of the intermediate shaft portion of the rotating shaft is referred to as H, a length in the axial direction of the bearing hole of the partition plate is referred to as Hp, an inner diameter of the bearing hole of the partition plate is referred to as Dp, an outer diameter of the other crank portion adjacent to the second bearing is referred to as Dc, an outer diameter of the intermediate journal portion of the rotating shaft is referred to as Dm, an axial length of a first chamfered portion provided at an edge located on a side of the intermediate shaft portion, of the other crank portion, is referred to as C1, an axial length of a second chamfered portion provided at an opening edge located on the side of the other crank portion, of the bearing hole, is referred to as C2, an axial length of a third chamfered portion provided at an edge on the side of the intermediate shaft portion, of the intermediate journal portion, is referred to as C3, and an axial length of a fourth chamfered portion provided at an opening edge located on the side opposite to the second chamfered portion, of the bearing hole, is referred to as C4, Dp is larger than Dc and Dm, and all relationships of

[Equation 1]

$$H \leq Hp \tag{1}$$

[Equation 2]

$$H > Hp - C1 - C2 - \sqrt{(Dp^2 - Dc^2)} \tag{2}$$

[Equation 3]

$$H > Hp - C3 - C4 - \sqrt{(Dp^2 - Dm^2)} \tag{3}$$

are satisfied, a suction port to which the working fluid is guided, and two branch passages branched from the suction port toward the cylinder chambers corresponding to the two cylinder bodies opposed with the partition plate disposed therebetween, are formed inside the partition plate including the bearing hole, the partition plate including the bearing hole includes a relief recess portion continuous with the bearing hole, the relief recess portion is opened toward the other crank portion adjacent to the second bearing and has a shape larger than the outer diameter of the other crank portion, the partition plate includes an end surface located on a side of the cylinder body corresponding to the other crank portion adjacent to the second bearing, one of the branch passages and the relief recess portion are arranged and opened on the end surface, and the relief recess portion is opened to the end surface of the partition plate, at a position eccentric in a direction of being farther from the one of the branch passages with respect to a central axis of the rotating shaft.

2. The rotary compressor of claim 1, wherein the rotating shaft is an integrated structure in which the first journal portion, the second journal portion, the intermediate journal portion, the plurality of crank portions, and the intermediate shaft portion are formed integrally, and the outer diameter of the other crank portion adjacent to the second bearing is smaller than an outer diameter of the one of the crank portions.

3. The rotary compressor of claim 2, wherein, a center of gravity of the structure including the compression mechanism unit and the drive source is located between the support member and the partition plate.

4. The rotary compressor of claim 1, wherein the spacer is exposed to the cylinder chamber corresponding to the other crank portion adjacent to the second bearing, and includes an end surface with which a roller fitted on an outer peripheral surface of the other crank portion is slidably in contact, and a communication port communicating the one of the branch passages of the partition plate with the cylinder chamber corresponding to the other crank portion adjacent to the second bearing is opened on the end surface.

5. The rotary compressor of claim 1, further comprising:

a support member supporting the cylinder body closest to the drive source, wherein the support member is separated from the partition plate in the axial direction of the rotating shaft, and the support member and the partition plate are fixed to an inner peripheral surface of the sealed container.

6. A refrigeration cycle apparatus, comprising:

a circulation circuit in which a refrigerant serving as a working fluid is circulated and to which a radiator, an expansion device, and a heat absorber are connected; and the rotary compressor of claim 1 connected to the circulation circuit at a position between the radiator and the heat absorber.

* * * * *